US011946242B2

(12) United States Patent
Pareja Garcia

(10) Patent No.: US 11,946,242 B2
(45) Date of Patent: Apr. 2, 2024

(54) MODULAR FRAMING SYSTEM

(71) Applicant: Thriller Innovations Inc., Scarborough (CA)

(72) Inventor: Andres Antonio Pareja Garcia, Scarborough (CA)

(73) Assignee: Thriller Innovations Inc., Scarborough (CA)

( * ) Notice: Subject to any disclaimer, the term of this patent is extended or adjusted under 35 U.S.C. 154(b) by 82 days.

(21) Appl. No.: 17/383,885

(22) Filed: Jul. 23, 2021

(65) Prior Publication Data

US 2022/0025635 A1 Jan. 27, 2022

Related U.S. Application Data

(60) Provisional application No. 63/056,029, filed on Jul. 24, 2020.

(51) Int. Cl.
*E04B 1/18* (2006.01)
*E04C 3/02* (2006.01)
*E04C 3/30* (2006.01)

(52) U.S. Cl.
CPC ..... *E04B 1/185* (2013.01); *E04C 3/02* (2013.01); *E04C 3/30* (2013.01)

(58) Field of Classification Search
CPC ..... A01G 9/12; A01G 17/06; A47B 47/0083; A47B 96/1408; E01F 13/02; E04B 1/185; E04C 3/02; E04C 3/30
See application file for complete search history.

(56) References Cited

U.S. PATENT DOCUMENTS 4,125,973 A * 11/1978 Lendrihas ..... E04B 1/2403 249/188
5,743,412 A * 4/1998 Noble ..... A47F 1/121 211/182
5,906,341 A * 5/1999 Brown ..... F16L 3/227 248/68.1
6,971,528 B2 * 12/2005 Chen ..... A47B 57/40 211/187
7,060,002 B1 * 6/2006 Boehme ..... A63B 9/00 482/35
7,448,634 B1 * 11/2008 Raub ..... A47F 5/083 211/186
7,717,837 B2 * 5/2010 Florczak ..... A63B 1/00 482/62
7,856,756 B1 * 12/2010 Caruso ..... A01G 9/023 211/182
10,441,074 B2 * 10/2019 Dahatonde ..... A47B 96/1441

(Continued)

*Primary Examiner* — Brian E Glessner
*Assistant Examiner* — Daniel J Kenny
(74) *Attorney, Agent, or Firm* — Dorf Nelson & Zauderer LLP; Scott D. Locke, Esq.

(57) ABSTRACT

A modular framing system with assorted connection devices which permit customization of the modular frame system for a variety of purposes. Connection devices include bases, adapters, extenders, connectors and enclosers. Connection devices have male and/or female components allowing the connection devices to fit together in a variety of configurations to form a variety of modular frames. A further connection device is an attachment connector that is connected to a side wall opening of the base, adapter, extender, connector or encloser and creates a platform that may be varied in size and an object may be placed on the platform.

14 Claims, 45 Drawing Sheets

(56) References Cited

U.S. PATENT DOCUMENTS

| | | | | |
|---|---|---|---|---|
| 10,617,069 | B2 * | 4/2020 | MacDonald | A01G 9/12 |
| 10,813,832 | B2 * | 10/2020 | Qiu | A47F 5/103 |
| 11,378,204 | B2 * | 7/2022 | Ball | F16L 3/18 |
| 2021/0355642 | A1 * | 11/2021 | Ingleby | E01F 9/692 |

* cited by examiner

MODULAR FRAMING SYSTEM

CROSS-REFERENCE TO RELATED APPLICATION

This patent application claims the benefit of U.S. provisional patent application Ser. No. 63/056,029, filed on Jul. 24, 2020, the entire disclosure of which is incorporated herein.

FIELD OF THE INVENTION

The present invention relates to modular framing systems, and more specifically to modular framing systems with assorted connection devices to permit customization of the modular frame to be used for a variety of purposes, such as a hurdle, trellis, umbrella stand, agility pole system, tent frame or crowd control barrier.

BACKGROUND OF THE INVENTION

Modular framing systems are individual component pieces that join to form a frame. The parts of these systems may be custom-made or standard and are generally designed to be easily assembled and disassembled with no, or minimal, use of tools and hardware. These frame systems are often made of plastic, aluminum, steel, or composite.

Modular framing systems are used for a wide variety of purposes ranging from toys to large scale construction projects. Use of a modular system can be advantageous as it is easy to assemble and disassemble, allowing for ease of transport and storage. These modular systems allow an operator to use a standardized set of component parts to create different shapes and sizes of framing structures that fit their creative and operational needs with minimized costs, in part, by reducing the diversity of parts in a product range.

Modular systems allow for fast and easy assembly, and for more efficient customization of the desired frame/structure than traditional construction systems and premade unitary frames. A user is able to simply select the necessary parts needed to achieve the desired structure which saves design time as the reliability of the system is tested and known, as is the cost and quality of the modular system.

A modular framing system is also often easy to repair as it permits for the replacement of worn parts (which may then be recycled) without having to change the entire structure. Replaceable component parts and ease of assembly and disassembly mean that if any future problems arise with the design of the structure or if a redesign exercise takes place, the modular structure can be improved without needing to entirely dispose of the existing structure; it can simply be disassembled and reassembled into the redesigned structure.

Modular framing systems are generally known and may use different means to hold the modular elements together. Modular components are frequently held together using a simple male-female connection that may optionally be secured using nuts, bolts, nails, or other fastening means. Male-female connections have been taught to connect modular systems in, for example, U.S. Pat. Nos. 8,475,226 and 3,577,671. The use of brackets to hold components of the modular system together or in place is also known in modular framing systems. See, for example, U.S. Pat. No. 4,449,842, Canadian patent application No. 3,053,279, and French Patent No. FR1035978.

U.S. publication number US20050163564 discloses a construction system having structural elements and connector members for joining the structural elements together. Fasteners are used to secure the structural elements and the connector members together.

Bases may be used in modular systems to create a system that does not need to be secured to the ground or other surface to provide stability. For example, in U.S. publication number 20170307131 a utility support is disclosed comprising a bottom base with a tapering side wall extending from the bottom base to the top base and the side wall has a utility portion allowing different objects to be attached to or placed upon.

Modular framing systems are known to have use in sport and agility training; see U.S. Pat. No. 10,532,260; U.S. Design Pat. No. D736,328; Canadian Patent No. 2,263,688; U.S. publication number US20020065153; and U.S. Pat. No. 8,057,329. However, each of these bases and modular systems provide limited modularity.

SUMMARY OF THE INVENTION

In an embodiment of this invention there is a modular framing system having a base that is substantially hollow having a base top, a base bottom and base side walls having openings, wherein the base top is a female-shaped opening; an adapter that is substantially hollow having an adapter top, an adapter bottom and adapter side walls having openings, wherein the adapter top is a female-shaped opening and the adapter bottom is a male-shaped opening such that the adapter bottom is shaped to be received by the base top; one or more extenders that are substantially hollow having an extender top, an extender bottom and extender side walls having openings, wherein the extender top is a female-shaped opening and the extender bottom is a male-shaped opening such that the extender bottom is shaped to be received by the adapter top; and at least one attachment connector comprising an attachment connector bracket and an attachment connector tongue, wherein the attachment connector tongue comprises, an extended arm with a first and second end, said first end having an end plate that is substantially perpendicular to the extended arm, the attachment connector bracket comprises, a bracket overhang that is adapted to fit into the base side walls openings, the adapter side wall openings, the connector side wall openings, or the top piece side wall openings, a bracket base wall, a bracket side wall, a bracket end wall, and a bracket opening adapted to slideably receive the attachment connector tongue, wherein a space defined by bracket base wall, bracket side wall, the end plate and the extended arm create a platform that may be varied in size by sliding the attachment connector tongue towards and away from the bracket through the bracket opening.

In an embodiment of the present invention, the modular framing system also has an encloser with a male-shaped encloser top bottom adapted to be received by the extender top or the adapter top, and a top portion of the encloser is decorative.

In an embodiment of the present invention, the modular framing system also has a connector with at least one male end that is adapted to be received by the extender top or the adapter top.

In a further embodiment of the present invention, there is a modular framing system having a base that is substantially hollow having a base top, a base bottom and base side walls having openings, wherein the base top is a male-shaped opening, one or more extenders that are substantially hollow having an extender top, an extender bottom and extender side walls having openings, wherein the extender top is a female-shaped opening and the extender bottom is a male-shaped opening such that the extender top is shaped to be received by the base top. This embodiment of the modular framing system may also have at least one attachment connector adapted to be removeably attached to any one of the openings in the base, extender or top, and the at least one attachment connector has a bracket overhang that is adapted to fit into the base side walls openings, the adapter side wall openings, the connector side wall openings, or the top piece side wall openings, a bracket base wall, a bracket side wall, a bracket end wall, and a bracket opening adapted to slideably receive the attachment connector tongue, wherein a space defined by bracket base wall, bracket side wall, the end plate and the extended arm create a platform that may be varied in size by sliding the attachment connector tongue towards and away from the bracket through the bracket opening.

BRIEF DESCRIPTION OF THE FIGURES

These and other aspects of the present invention will be apparent from the brief description of the drawings and the following detailed description in which:

FIG. 38C is a cross-sectional view of FIG. 38B taken along the line 38C-38C.

DETAILED DESCRIPTION OF THE INVENTION

In an embodiment of the present invention there is provided a multipurpose modular framing system comprising one or more modular units that can be used for a variety of purposes, including general construction, hurdles for track and field, agility poles used for agility training for athletes and canines, crowd control barricades, tent structures, frames for sheds, greenhouses and housing, goal posts for soccer, hockey, netting fixtures for activities such as badminton, beach/sun umbrella holder, along with other structures.

Figure 1:
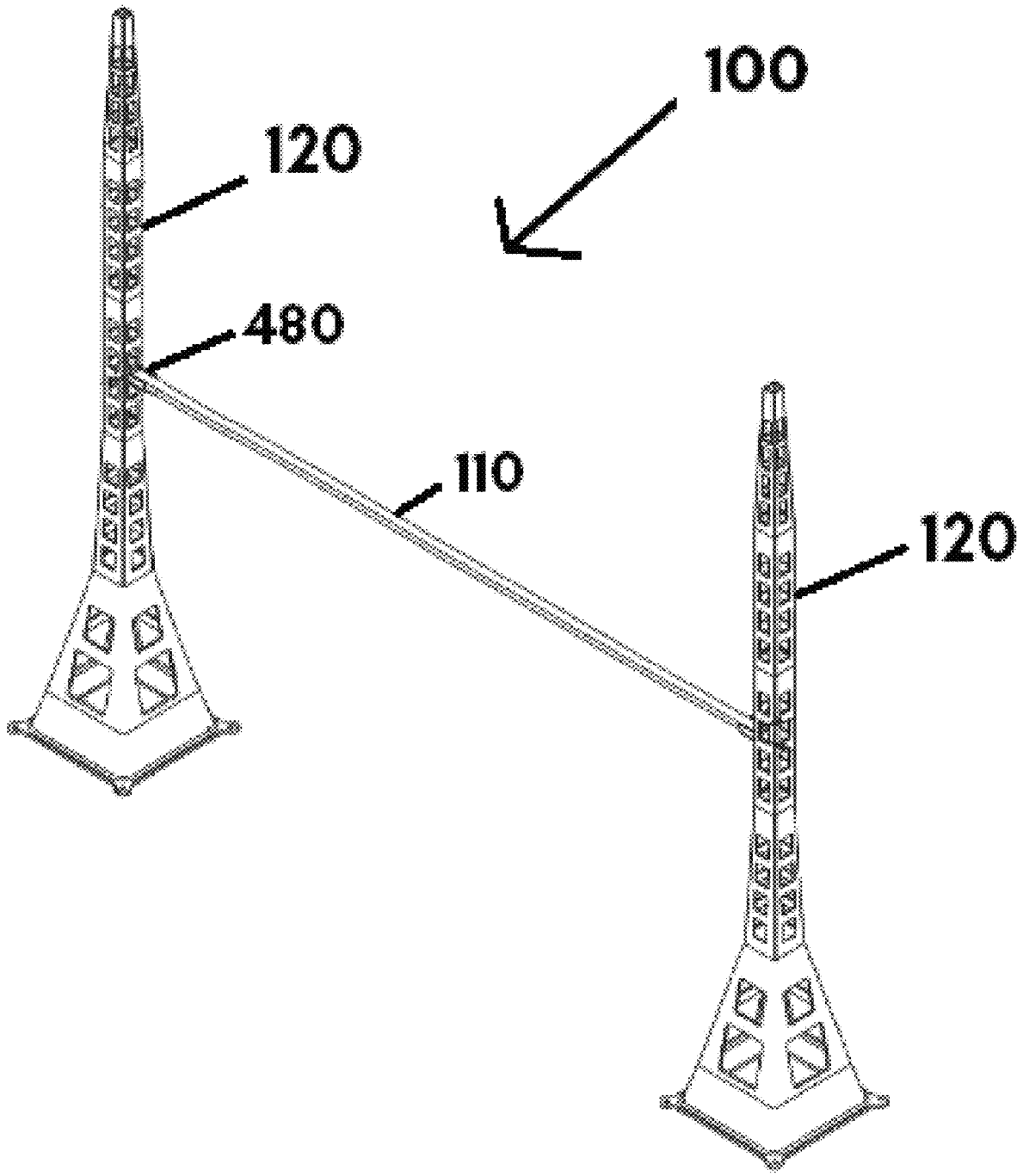
FIG. 1 is a perspective view of a multi-purpose modular framing system of the present invention connected by a supporting bridge.
Figure 2:
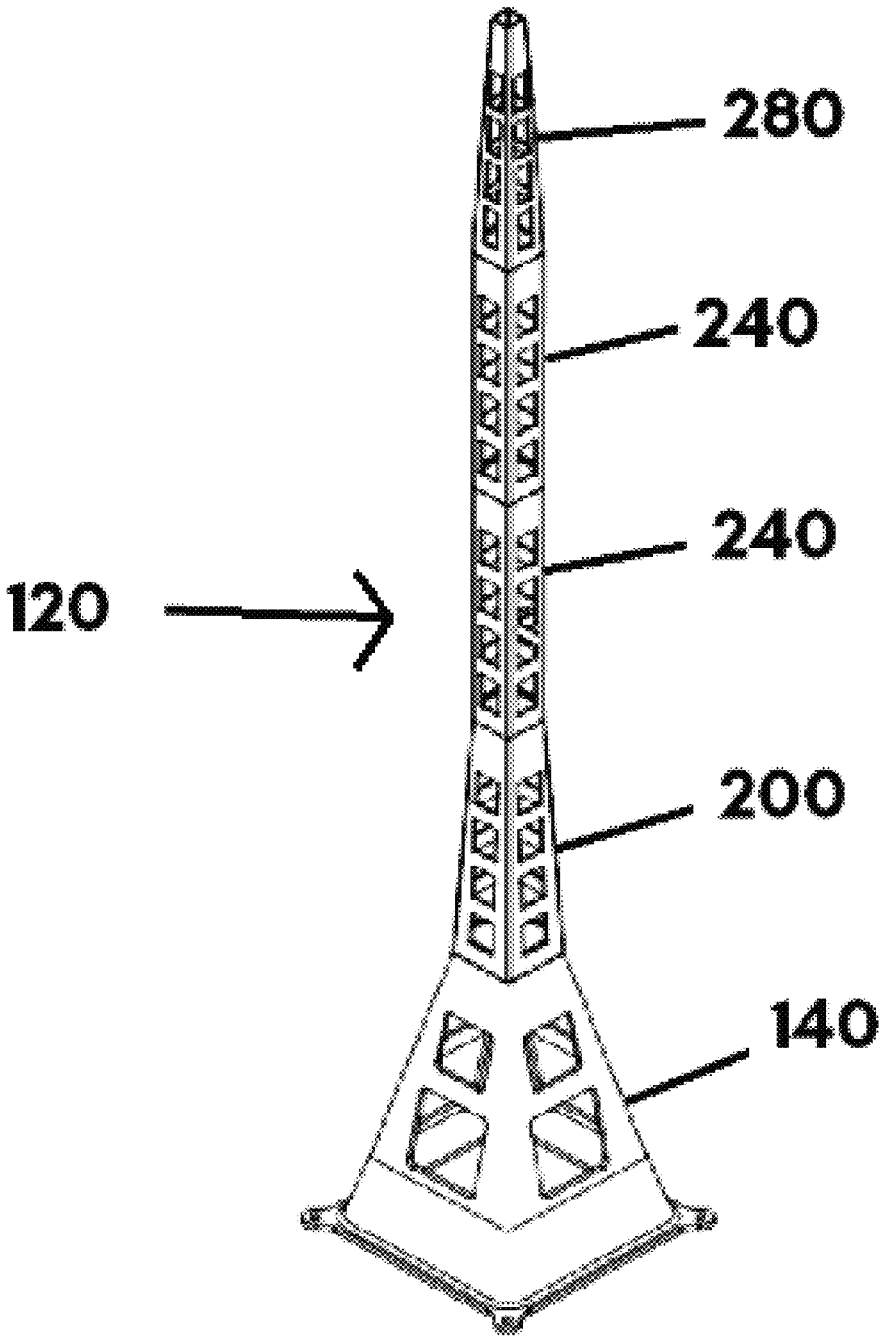
FIG. 2 is a perspective view of an assembled multi-purpose modular frame system of an embodiment of the present invention having an encloser.
Figure 4:
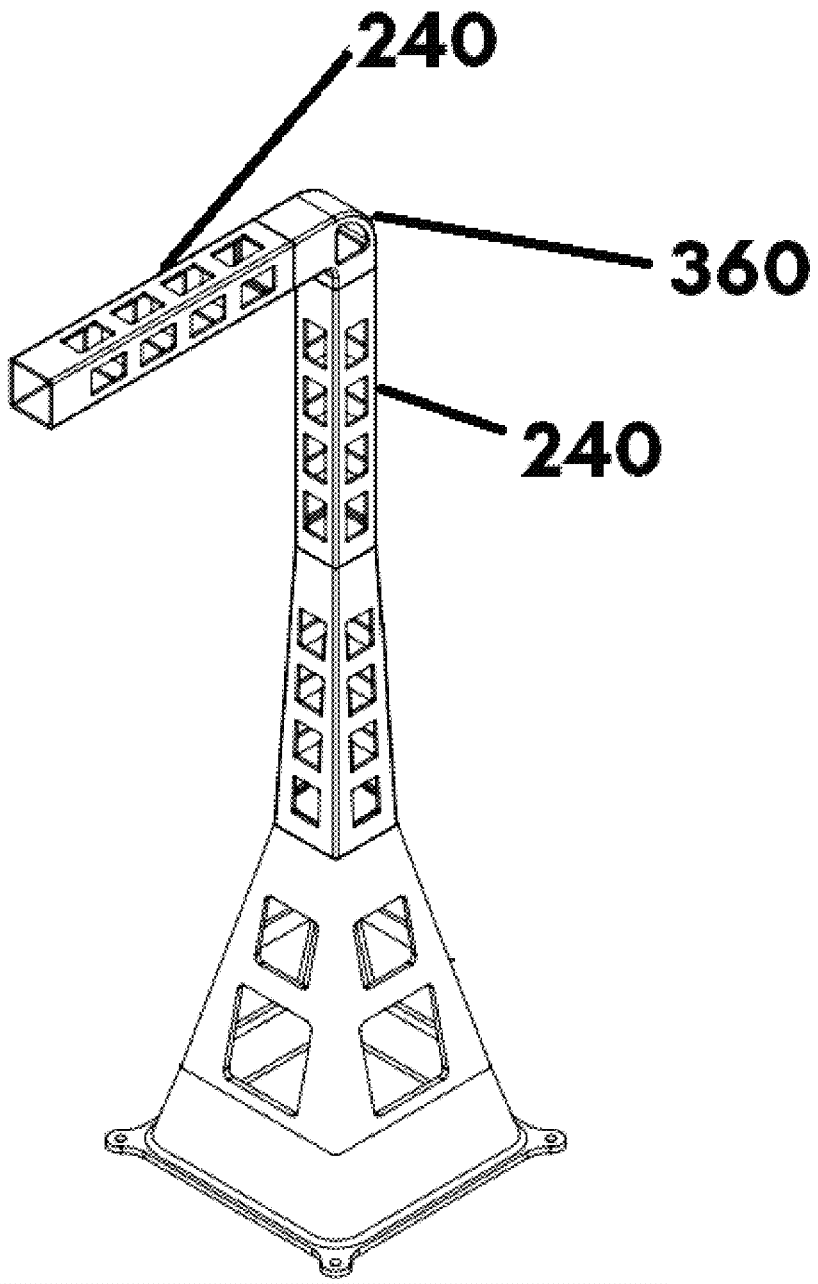
FIG. 4 is a perspective view of FIG. 3 having an extender attached to an end of an elbow connector.
Figure 5:
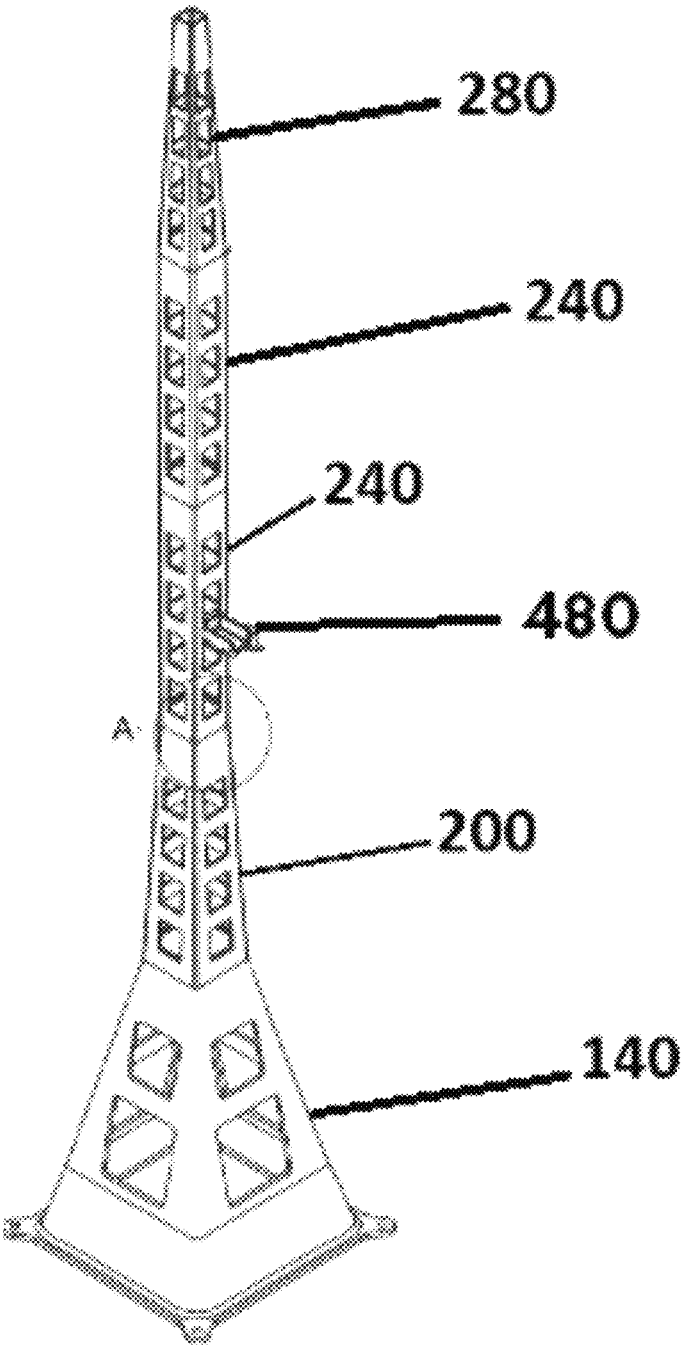
FIG. 5 is a perspective view of an assembled multi-purpose modular frame system of an embodiment of the present invention having an encloser and an attachment connector removeably attached onto a side of the assembled multi-purpose modular framing system.
Figure 19:
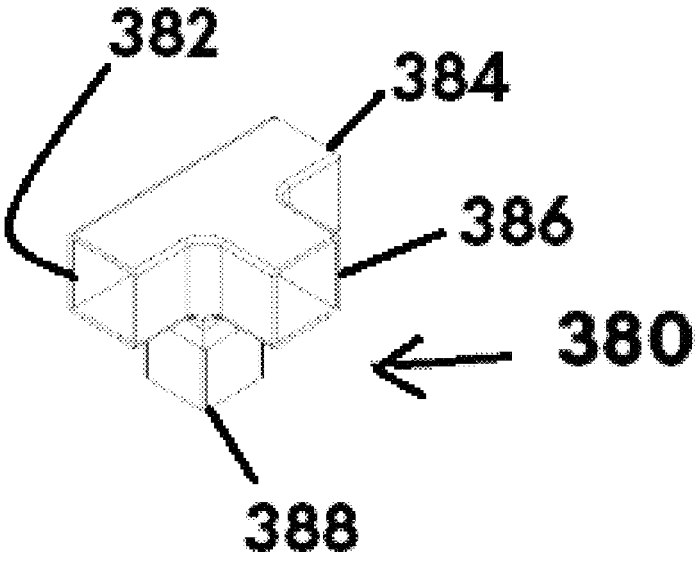
FIG. 19 is a perspective view of a 3-sided connector.
Figure 20:
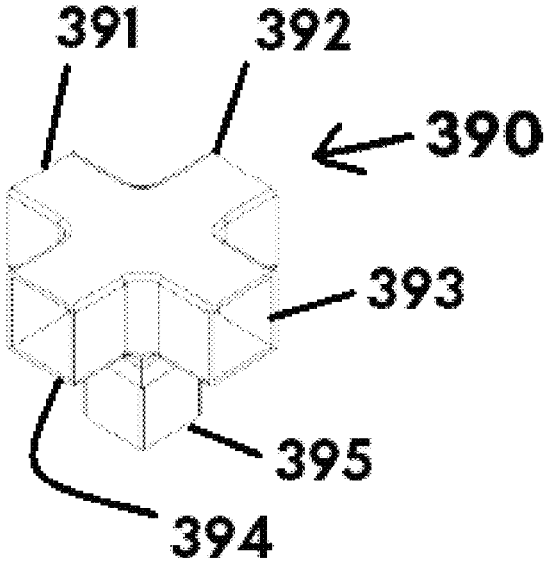
FIG. 20 is a perspective view of a 4-sided connector.
Figure 22:
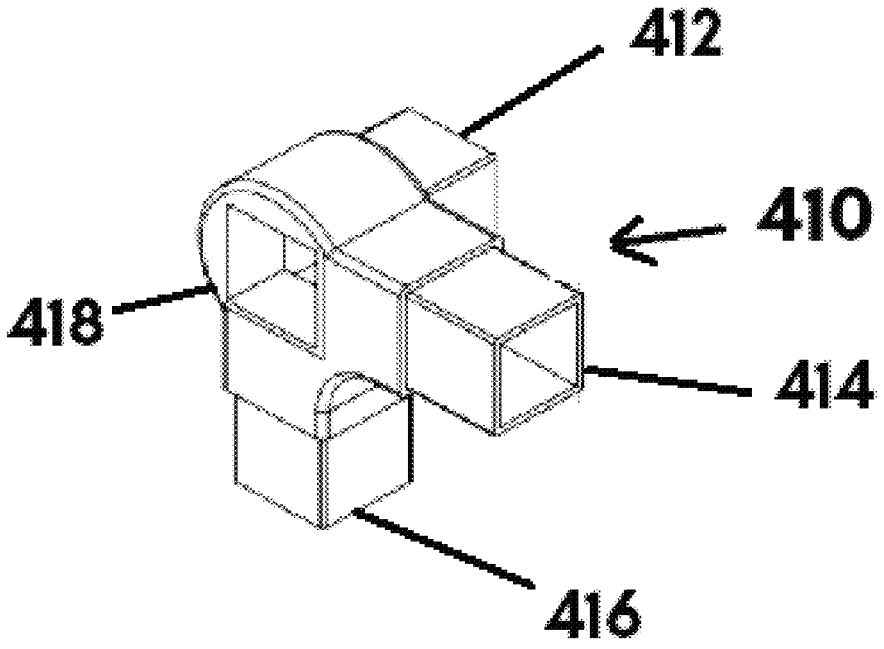
FIG. 22 is a perspective view of 3-male 1-female connector.
Figure 23:
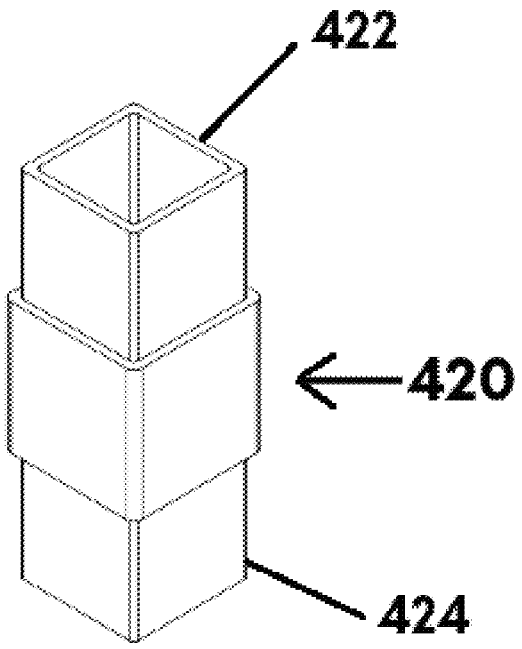
FIG. 23 is a perspective view of 2-male connector.
Figure 24:
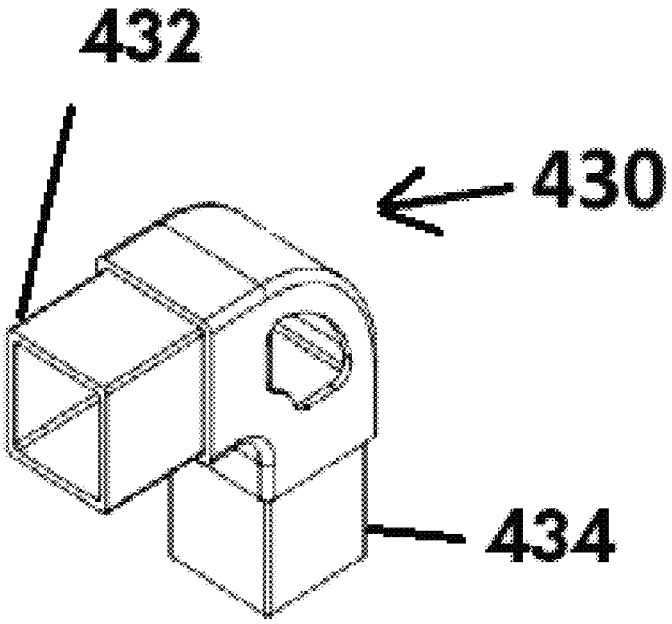
FIG. 24 is a perspective view of a male elbow connector.
Figure 25:
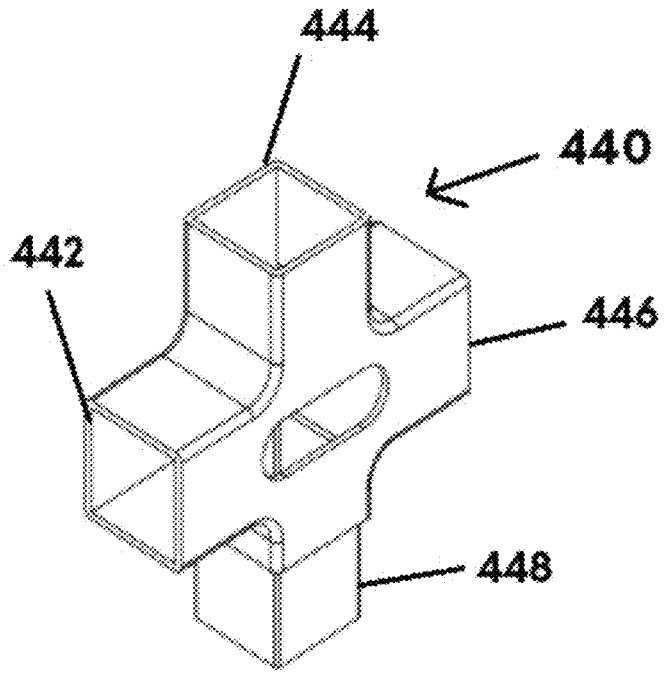
FIG. 25 is a perspective view of a 3-female 1-male connector.
Figure 26:
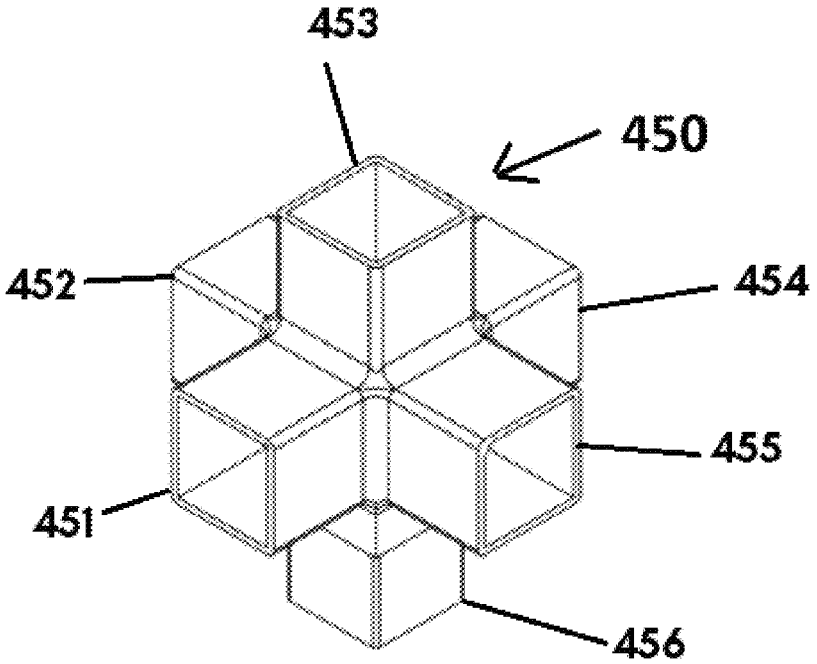
FIG. 26 is a perspective view of a 5-female 1-male connector.
Figure 35A:
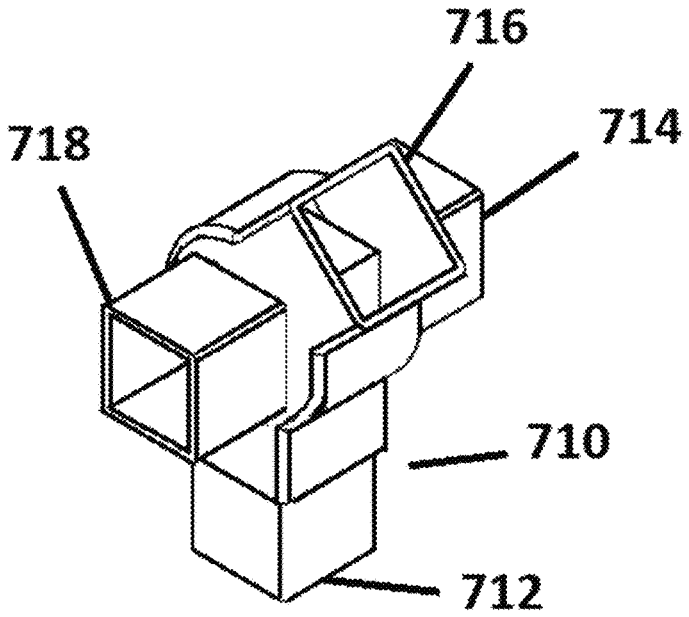
FIG. 35A is a perspective view of a 3-female 1-male angled connector.
Figure 35B:
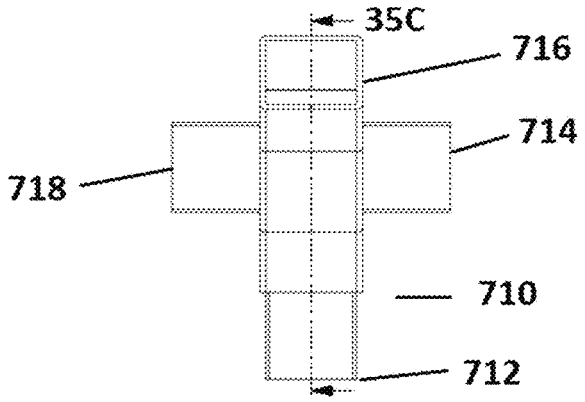
FIG. 35B is a side view of FIG. 35A.
Figure 35C:
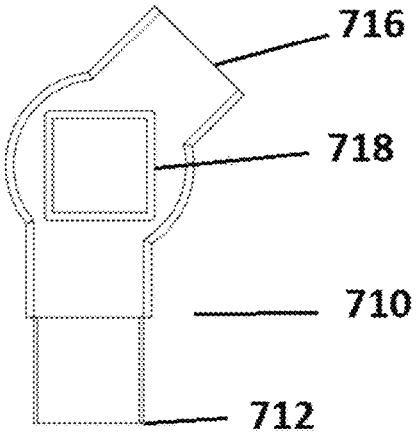
FIG. 35C is a cross-sectional view of FIG. 35B taken along the line 35B-35B.
Figure 36A:
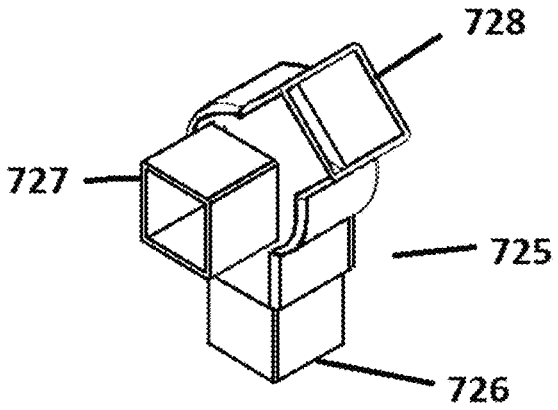
FIG. 36A is a perspective view of a 2-female 1-male angled connector.
Figure 36B:
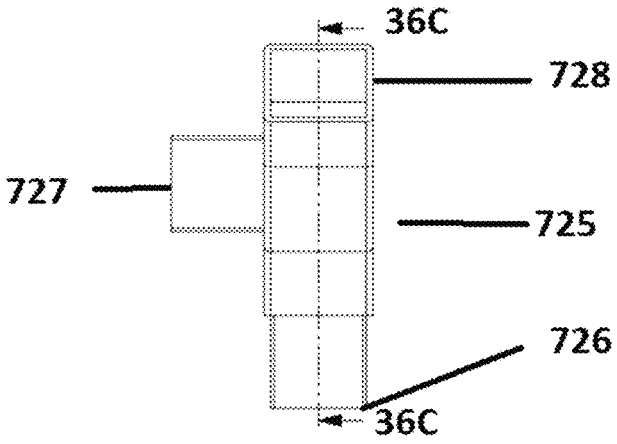
FIG. 36B is a side view of FIG. 36A.
Figure 36C:
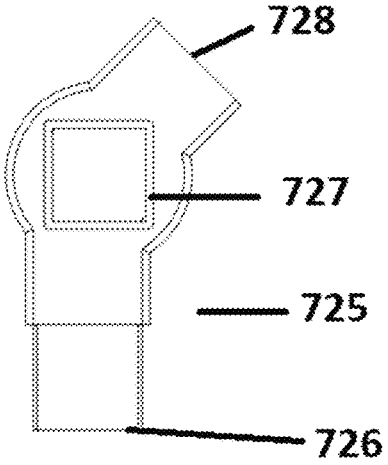
FIG. 36C is a cross-sectional view of FIG. 36B taken along the line 36C-36C.
Figure 37A:
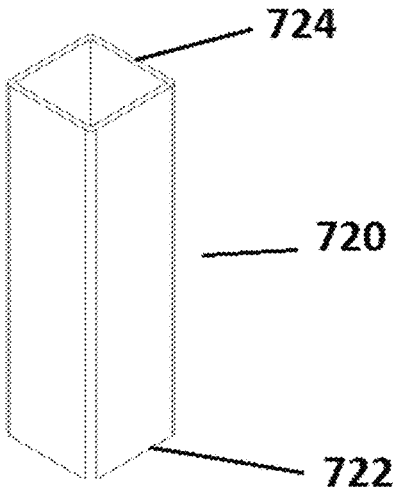
FIG. 37A is a perspective view of a stretched 2-female connector.
Figure 37B:
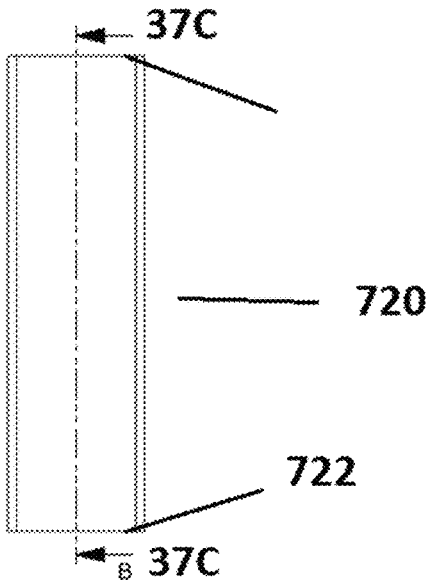
FIG. 37B is a side view of FIG. 37A.
Figure 37C:
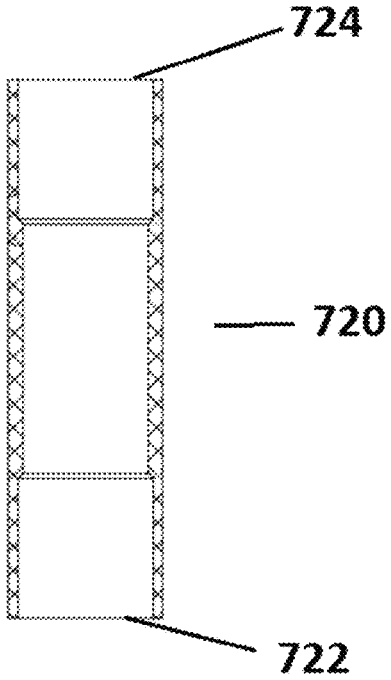
FIG. 37C is a cross-sectional view of FIG. 37B taken along the line 37C-37C.
Figure 39A:
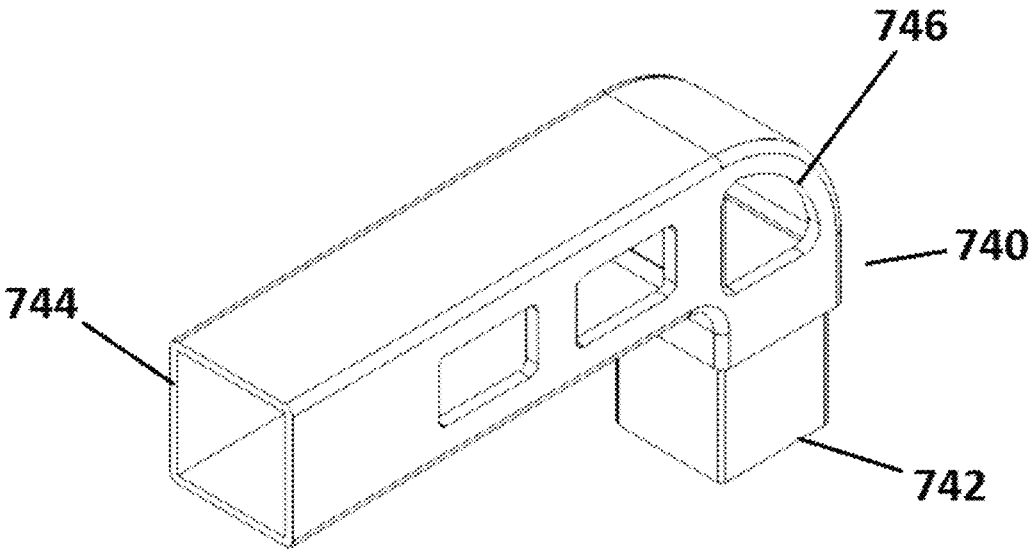
FIG. 39A is a perspective view of a male female elbow connector.
Figure 39B:
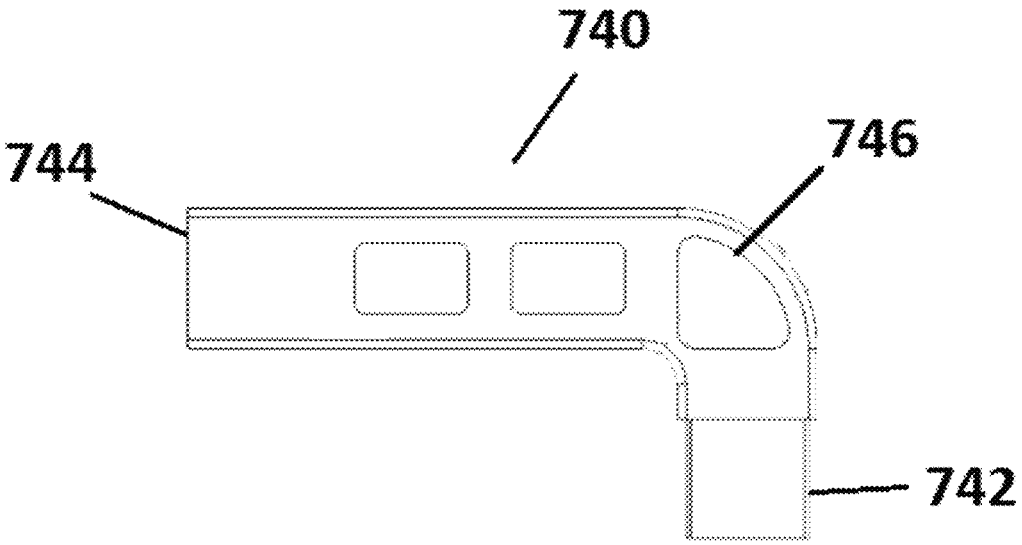
FIG. 39B is a side view of FIG. 39A.

As shown in FIG. 1, an embodiment of the present invention comprises a multipurpose modular framing system 100 having two modular units 120 connected by a rod 110 or another device that connects the modular units to one another. In an embodiment of the present invention, each modular unit 120 comprises a base 140 and an adapter 200. In an embodiment of the present invention, the modular unit 120 may also comprise one or more extenders 240, as shown in FIG. 2. The modular unit 120 also comprises a top which is either connected to the adapter 200 directly or to an extender 240. The top of the modular unit may be an encloser 280 as shown in FIGS. 1, 2 and 5 which acts to end the modular unit 120, or it may be a connector that acts to extend the top of the modular unit 120 by connecting it to other component parts of the modular system. Connectors include: a male-female elbow connector 360 as shown in FIG. 3, 4, 16, 17, 39A and 39B; or a 2-female 1-male connector 370 (FIG. 18), 3-female 1-male connector 380 (FIG. 19), 4-female 1-male connector 390 (FIG. 20), a 2-male angled connector 400 (FIG. 21), a 1-female 3-male connector 410 (FIG. 22), 2-male connector (FIG. 23), a 2-male elbow connector 430 (FIG. 24), 3-female 1-male cross connector 440 (FIG. 25), 5-female 1-male connector 450 (FIG. 26), a female-female connector 660 (FIGS. 32A to 32D), a 3-female 1-male angled connector (FIGS. 35A to 35C), a 2-female 1-male angled connector (FIGS. 36A to 36C), a 2-female connector (FIG. 37A to 37C), or a male female elbow connector (FIGS. 39A to 39B).

The component parts of an embodiment of the modular framing system of the present invention, including the base, adapter, extenders, encloser and connectors, are substantially hollow. The hollow nature of these parts allows the present invention to be lightweight as compared to solid structure modular systems. Being light weight increases ease of transport and assembly/disassembly. It also allows for materials to be inserted into the openings, such as string lights, wiring, etc.

Figure 5A:
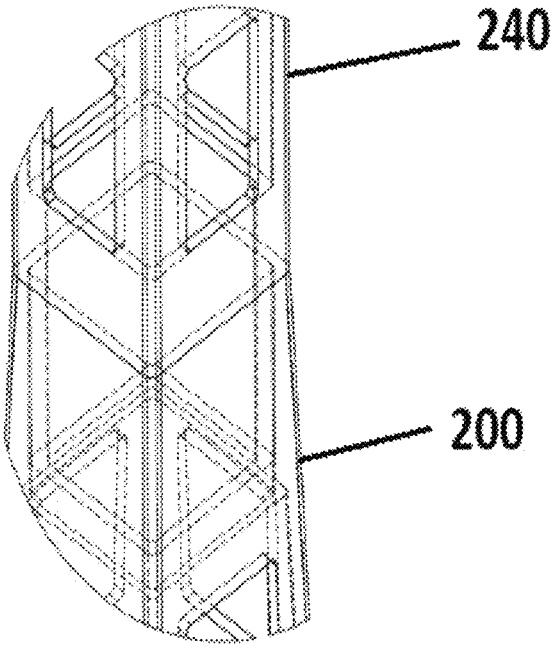
FIG. 5A is an enlarged view of A from FIG. 5 showing the connection between an adapter and an extender.

As shown in FIG. 5, an embodiment of the present invention comprises a base 140, an adapter 200, two extenders 240, an encloser 280, and an attachment connector 480 attached to an opening of an extender 240. The connection between the adapter 200 and an extender 240 is shown in FIG. 5A, and as further described below, comprises a female shaped adapter top 220 being received in a male shaped extender bottom 250.

Figure 6:
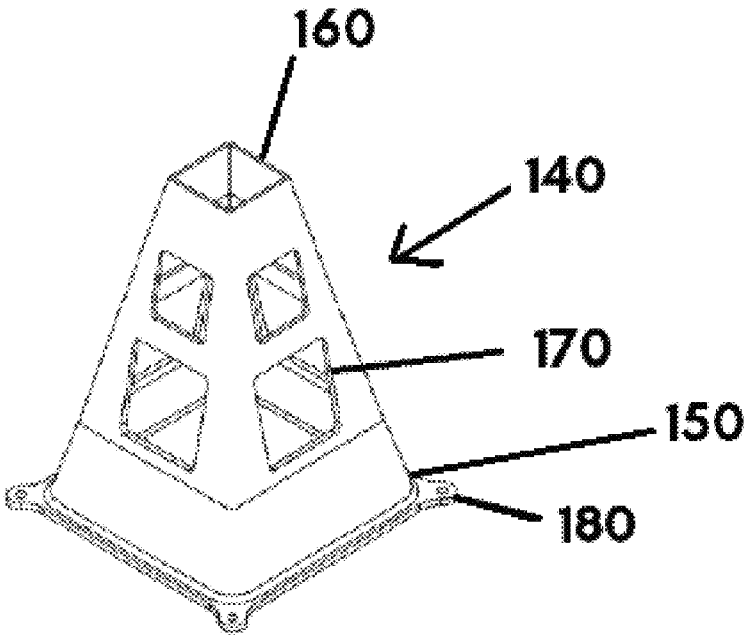
FIG. 6 is a perspective view of an embodiment of a pyramid base of the present invention.
Figure 7:
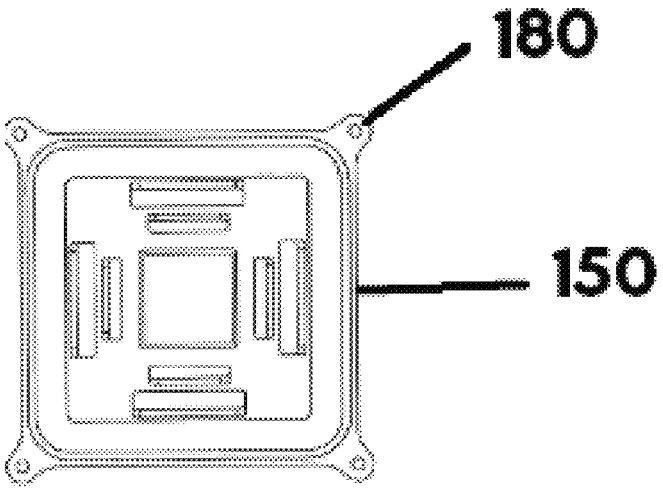
FIG. 7 is a bottom view of the base of FIG. 6.

In an embodiment of the present invention, a pyramid base 140, as shown in FIG. 6, has a base top 160 and a base bottom 150. The base bottom 150 rests on the ground or other surface and supports and stabilizes the modular unit 120. The base 140 may optionally comprise peg holes 180 at one or more corners of the base to insert pegs, stakes or similar objects into the peg holes 180 to secure the base 140 and thus a modular unit 120 into the ground or other surface. The peg holes also act to further stabilize the base in place when used to ensure further stability against light impacts, high impacts, or strong winds.

The base top 160 and base bottom 150 are open and the base 140 is substantially hollow. The base top 160 has a female opening that is shaped to removably receive a male shaped adapter bottom 210 of the adapter 200 shown in FIG. 10A. The base top 160 and the adapter bottom 210 are configured to allow the adapter bottom 210 to slide securely into the base top 160 in a tight frictional engagement.

In an embodiment of the present invention shown in FIGS. 6 to 9C, the base 140 features an angled and pyramid shaped unit with openings 170 in the walls of the unit. This design allows wind to pass through giving the multi-purpose modular framing apparatus an aerodynamic structure for balance and resistance against strong winds and other impacts. When the multi-purpose framing system is being used for animal training, having openings in the base may assist a dog trainer for canine scent training, since scents can pass through the openings of the base and since a food treat may easily be dropped into the center of the base 140.

Figure 9A:
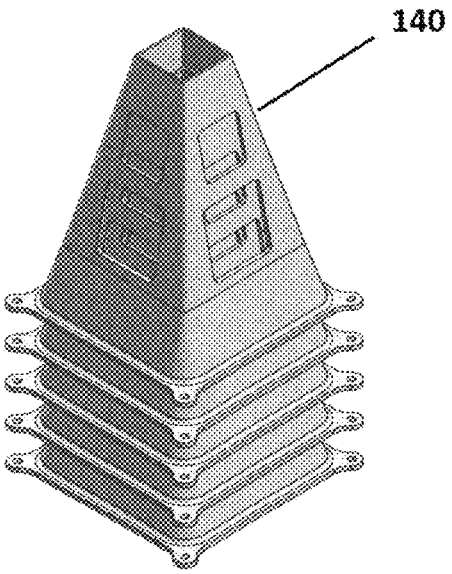
FIG. 9A is a perspective view of stacked base cones of an embodiment of the present invention.
Figure 9B:
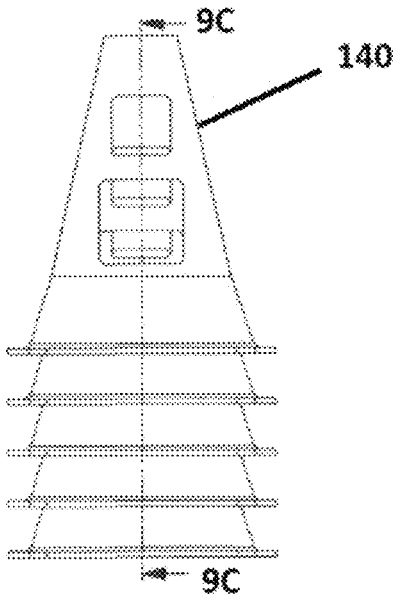
FIG. 9B is a side view of the stacked base cones of FIG. 9A.
Figure 9C:
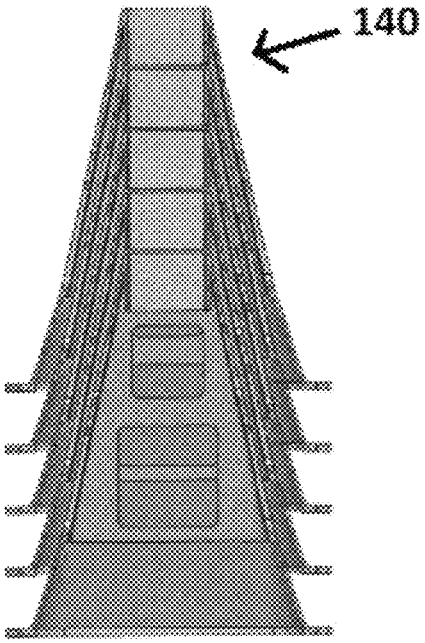
FIG. 9C is a cross-sectional view of the stacked base cones taken along the line 9C-9C from FIG. 9B.

The shape of the base 140 provides foundational stability for the system and permits the bases to be stacked for efficient storage and transport (see FIG. 9A to 9C). The base shape also adds foundational stability when an adapter 200 is connected to the base 140, as well as when adding extenders 240 to the adapter 200 or extenders on top of one another. The base openings 170 on the walls of the base 140 increase the aerodynamic shape of the base when it experiences windy conditions. The shape of this embodiment of the base is specifically designed for structural stability, aerodynamic as well as stack-ability for storage.

In an embodiment of the invention, the module unit comprises an adapter 200 that is removeably attached to the base 140 at the adapter bottom 210 and to an extender 240, an encloser 280, or a connector at the adapter top 220. The adapter 200 acts to further stabilize the modular unit as it prevents the extender 240 from wobbling, which may occur in instances where an extender is connected directly to the base.

In an embodiment of the present invention, the adapter 200 comprises a male shaped adapter bottom 210 and a female shaped adapter top 220; see FIGS. 10A to 10D. The male shaped adapter bottom 210 is adapted to slide tightly into the female shaped base top 160 providing a tight and secure frictional engagement. Once the adapter is secured into the base, the male end of the extender bottom 250 can be inserted into the female end of the adapter top 220 also providing a tight and secure frictional engagement. The adapter 220 provides balance and vertical stability and durability, particularly when extenders 240 are used to give vertical height to each modular unit 120.

Figure 10A:
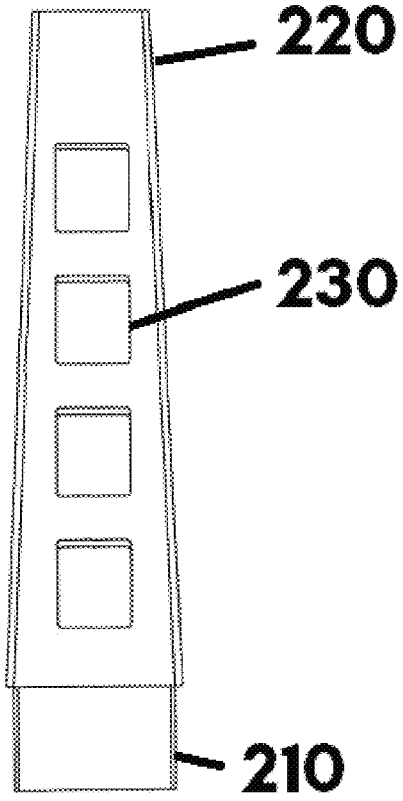
FIG. 10A is a side view of an adapter of an embodiment of the present invention.
Figure 10B:
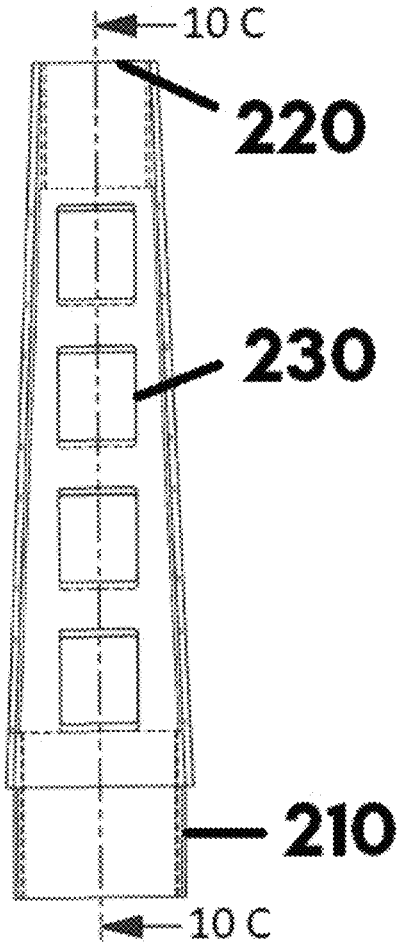
FIG. 10B is a side view of the adapter of FIG. 10A.

An embodiment of an adapter 220 is illustrated in FIGS. 10A to 10D. The adapter 220 is used to connect one or more extenders 240 to the base 140, see FIG. 12. A bottom view of the adapter 220 can be seen in FIG. 11 showing that the adapter is hollow and the adapter bottom 210 is designed to securely fit the base top 160.

In an embodiment of the present invention, the adapter top 220 is connected directly to an encloser 280 or a connector, rather than an extender. For example, the modular component connected to the adapter top 220 may include an encloser 280 or connectors, such as parts 360, 370, 380, 390, 400, 410, 420, 430, 440, 450 or 660. The male end of any one of the encloser or connectors slides into the female shaped adapter top 220 providing a tight and secure frictional engagement.

Figure 10C:
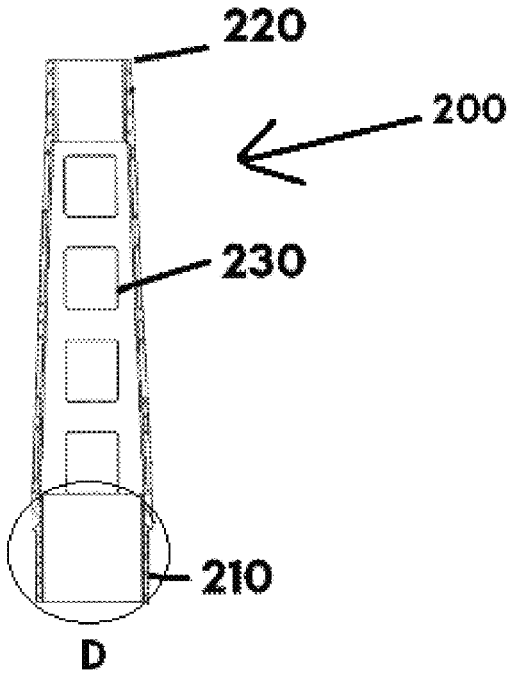
FIG. 10C is a cross-sectional view of an adapter taken along the line 10C-10C from FIG. 10B.
Figure 10D:
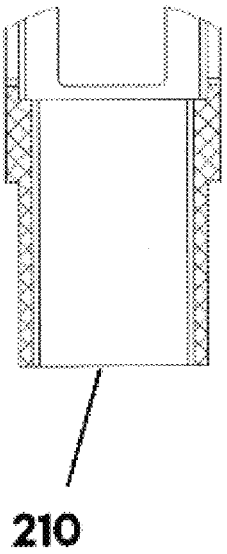
FIG. 10D is an enlarged view of the circle D shown in FIG. 10C.
Figure 11:
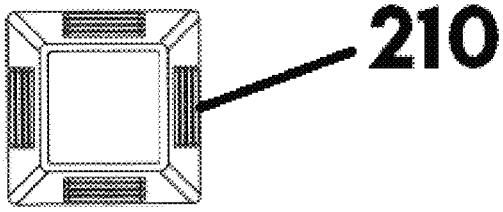
FIG. 11 is the bottom view of the adapter of FIG. 10A.

As shown in FIG. 10C, the walls of the adapter 200 comprise openings 230 to allow wind to pass through for aerodynamic stability and balance, as well as contribute to the modular framing system being light weight.

Figure 38A:
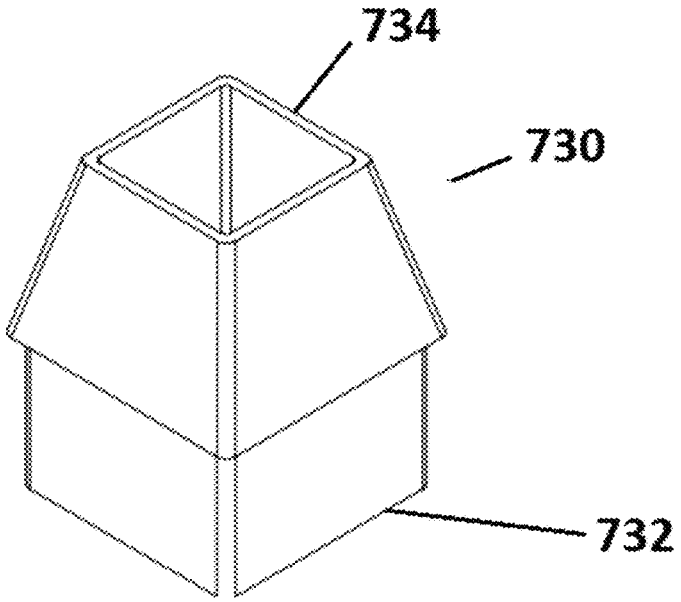
FIG. 38A is a perspective view of an adapter.
Figure 38B:
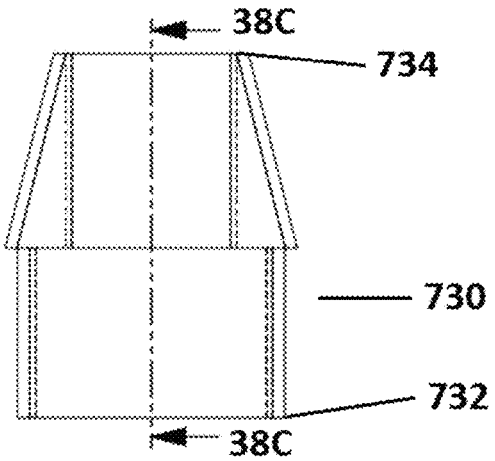
FIG. 38B is a side view of FIG. 38A.
Figure 38B:
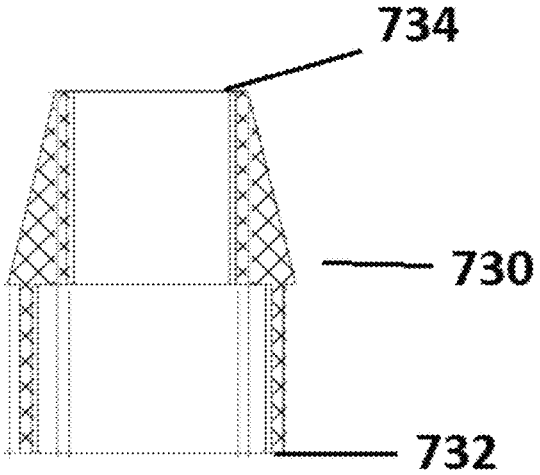

In a further embodiment as shown in FIGS. 38A, 38B and 38C, there is provided an adapter 730 having a female opening 732 to connect to a base 140 and a female end 734 to connect to a male end of an extender of a connecter. The adapter of FIGS. 38A, B and C allow for shorter structures to be created as it is shorter in length than the adapter of FIG. 10.

In an embodiment of the invention, the modular unit further comprises one or more extenders 240, see FIGS. 12A to 12D. The one or more extenders have a male-shaped extender bottom 250 and a female-shaped extender top 260. As seen in FIG. 5A, the extender 240 is connected to the adapter 200. In particular, the extender bottom 250 of one of the one or more extenders 240 is male shaped to be removeably attached to a female shaped adapter top 220 and the extender top of one of the one or more extenders is female shaped to be removeably attached to a male shape, such as the bottom 290 of an encloser 280.

It will be understood from the figures that the extender 240 has a bottom 250 that fits into the adapter top 220 but also into another extender top 260, and as such 220 and 260 are the same size female parts. Likewise, the bottom 290 of the encloser 280 is the same size as an extender bottom 250, as well as the male bottoms of connectors 360, 370, 380, 390, 400, 410, 420, 430, 440 and 450.

Figure 13:
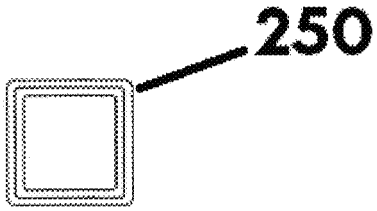
FIG. 13 is a bottom view of the extender shown in FIG. 12A.
Figure 14A:
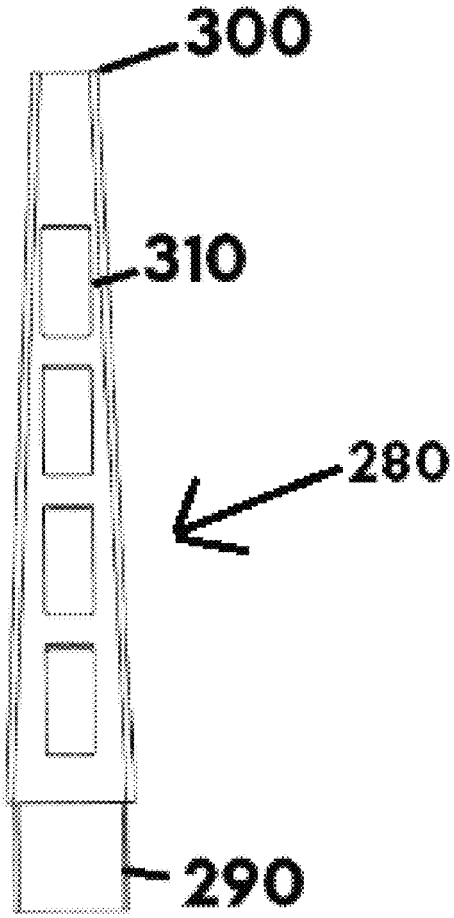
FIG. 14A is a side view of an encloser of an embodiment of the present invention.
Figure 14B:
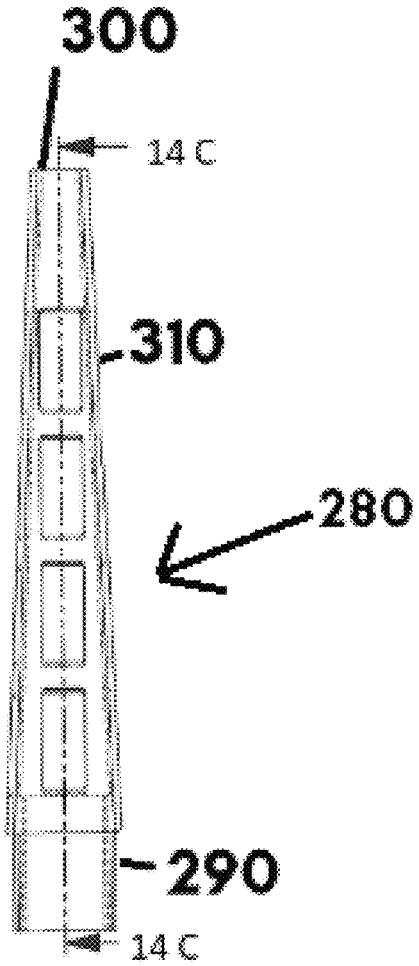
FIG. 14B is a side view of the encloser of an embodiment of the present invention.
Figure 14C:
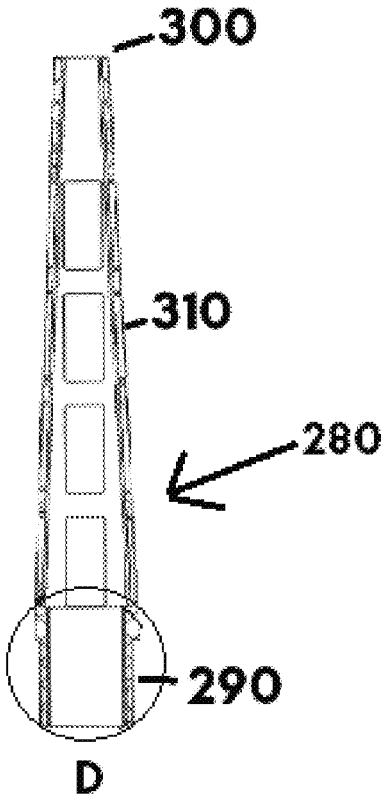
FIG. 14C is a cross-sectional view of the encloser taken along the line 14C-14C from FIG. 14B.
Figure 14D:
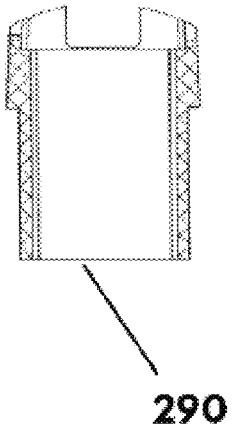
FIG. 14D is an enlarged view of the circle D shown in FIG. 14C.

The side walls of the one or more extenders have openings 240 to allow wind to pass through for aerodynamic stability and balance. FIG. 13 is the bottom view of an extender showing a hollow shape of the extenders and that the extender bottom 250 is designed to securely fit the adapter top 220 or the top of another extender 240.

In an embodiment of the invention, the dimensions of the extenders are about 13-15 inches in height to accommodate modularity and allow the operator to find a suitable height for the desired structure by adding more than one extender. It is understood that the extending connectors could be longer or shorter, or wider or narrower than that of those shown in the figures, provided the male-shaped extender bottom 250 fits into the female-shaped adapter top 220 and provided that the female-shaped extender top 260 fits into a male end of an encloser 280 or a connector.

Figure 15:
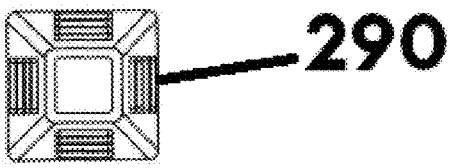
FIG. 15 is a bottom view of the encloser of FIG. 14A.

In an embodiment of the present invention, the encloser 280 (see FIGS. 14A to 14D), having a male end 290 (that securely slides in using friction to the female end 260 of an extender 240) and also having a top encloser end 300. The side walls of the encloser have openings 310 to allow wind to pass through for aerodynamic stability, to reduce the overall weight of the modular frame, and for balance. FIG. 15 shows a bottom view of the encloser 280 and the encloser male end 290 is designed to securely fit the female end 260 of the extender 240.

Other connectors include: a male-female elbow connector 360 as shown in FIG. 3, 4, 16 and 17; or a 2-female 1-male connector 370 (FIG. 18); 3-female 1-male connector 380 (FIG. 19); 4-female 1-male connector 390 (FIG. 20); a 2-male angled connector 400 (FIG. 21); a 1-female 3-male connector 410 (FIG. 22); 2-male connector (FIG. 23); a 2-male elbow connector 430 (FIG. 24); 3-female 1-male cross connector 440 (FIG. 25); 5-female 1-male connector 450 (FIG. 26); or a female-female connector 660 (FIGS. 32A-32D).

Figure 3:
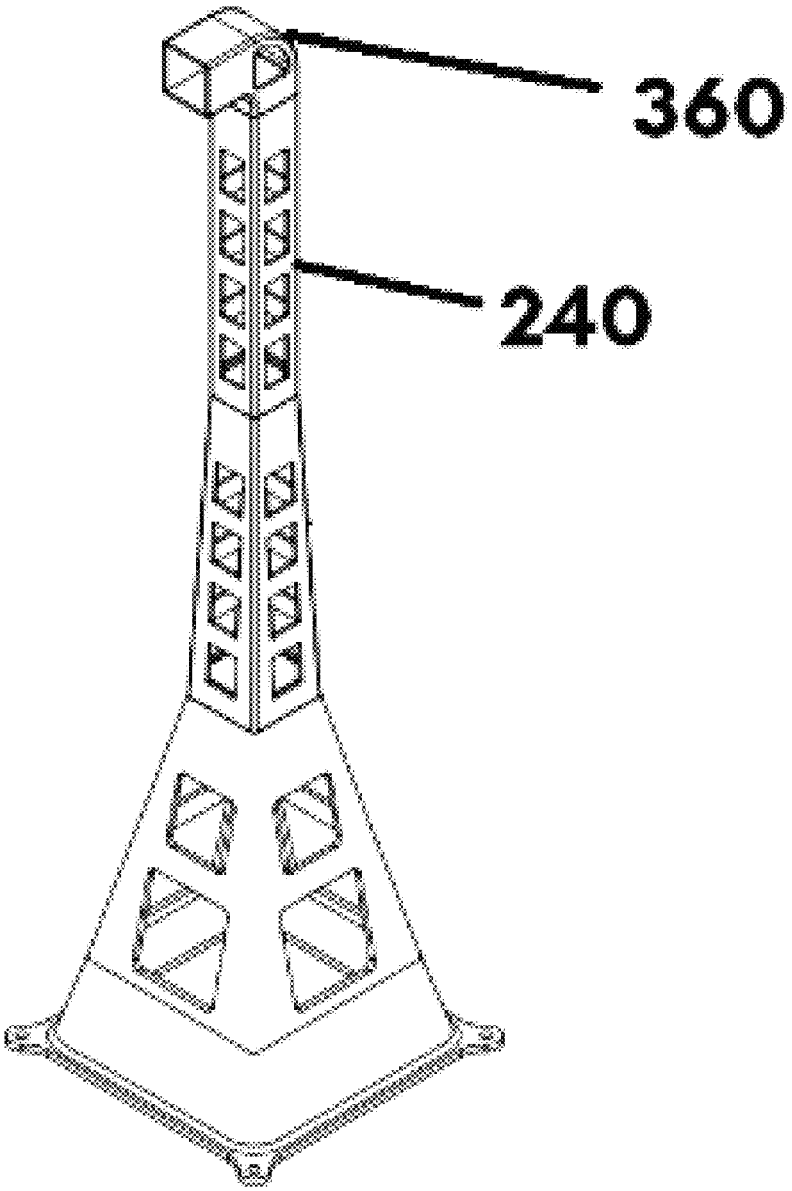
FIG. 3 is a perspective view of an assembled multi-purpose modular frame system of an embodiment of the present invention having an elbow connector.
Figure 16:
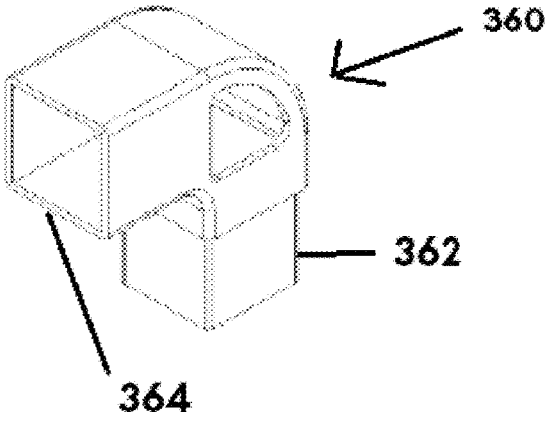
FIG. 16 is a perspective view of a male-female elbow connector.
Figure 17:
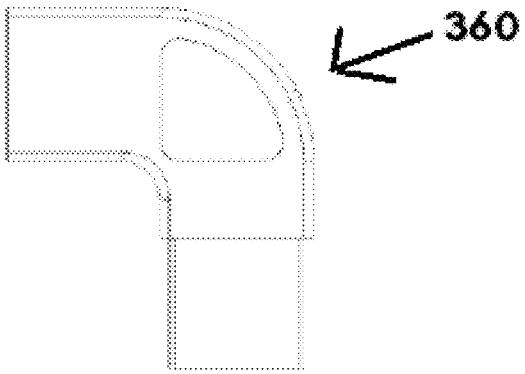
FIG. 17 is a side view of the elbow connector of FIG. 16.

The male-female elbow connecter 360 as illustrated in FIGS. 3, 16 and 17 is a curved connector. One end of the elbow 360 is a male shaped elbow connector bottom end 362 and the other end is a female shaped elbow connector top end 364. The male-female elbow connector bottom end 362 connects to any female end of any component part of the modular system.

Similarly, the female shaped elbow connector top end 364 connects into any male end of any component part of the modular system. For example, the male end 362 can connect to the female end 220 of the adapter 200 or the female end 260 of an extender 240, allowing the multipurpose modular framing system 100 to form a different shape and allow one or more said extenders 240 to be connected to one another horizontally as illustrated in FIG. 4 to create structural frameworks that may be used in construction. Such a structure may also be used, for example, as a horse or animal jumping apparatus, or as an apparatus for athletic hurdles.

Figure 18:
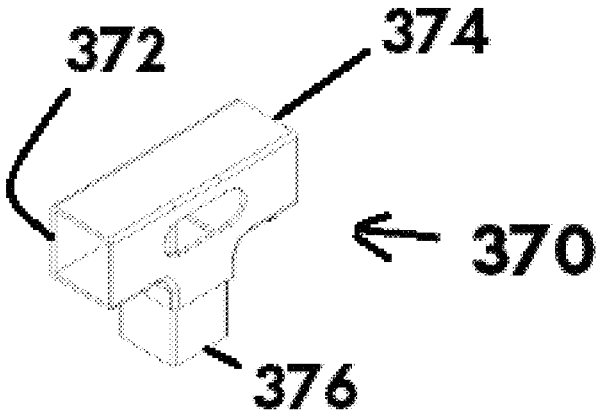
FIG. 18 is a perspective view of a 2-sided connector.

The 2-female 1-male connector 370 shown in FIG. 18 contains two female openings (372, 374) and a male end 376 to allow an extender 240 or any part with a male end to be connected thus allowing the system to take a different shape. The 3-female 1-male connector 380 shown in FIG. 19 contains three female openings (382, 384, 386) and a male end 388 to allow an extender 240 or any part with a male end to connect and allow the system to take a different shape. The 4-female 1-male connector 390 shown in FIG. 20 contains four female openings (391, 392, 393, 394) and a male end 395 to allow an extender 240 or any part with a male end to connect and allow the system to take a different shape.

Figure 21:
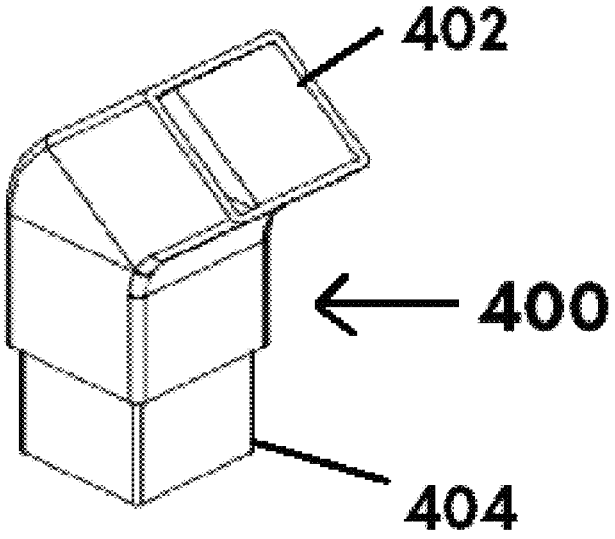
FIG. 21 is a perspective view of an angled connector.

The 1-male 1-female angled connector 400 shown in FIG. 21 contains a 402 female end to allow the bottom 250 of an extender 240 or any part with a male end 404 to connect and allow the system to take a different shape such as a roof like structure.

The 1-female 3-male connector 410 (FIG. 22) contains 3 male ends (412, 414, 416) and a female end 418 to allow the top 260 of an extender 240 or any part with a female end to connect to the male ends, and the female end 418 to connect with a male end, such as bottom 250, and allow the system to take a different shape and provide the operator to have the flexibility with form framing structures.

The 2-male connector 420 (FIG. 23) contains 2 male ends (422, 424) to allow the female end of an extender 240 or any part with a female end to connect and allow the system to convert the end piece from a female end to become a male end. This male-male connector piece 420 provides flexibility with form framing structures.

The 2-male elbow connector 430 (FIG. 24) contains 2 male ends (432, 434) to allow the female end of the extender 240 or any part with a female end to be connected. The 2-male elbow connecter 430 can be used when an operator of the modular system would like the system to take a different shape.

The 3-female 1-male cross connector 440 (FIG. 25) has 3 female ends (442, 444, 446) and 1 male end (448). The male end (448) can be connected to the female end of the extender 240.

The 5-female 1-male connector 450 (FIG. 26) has 5 female ends (451, 452, 453, 454, 455) and 1 male end (456). The male end (456) can be connected to the female end of the extender 240.

The female-female connector (FIG. 32A) has two female ends (662, 662).

The 3-female 1-male angled connector 710 (FIGS. 35A, 35B and 35C) has 3 female ends (714, 716, 718) and 1 male end 712.

The 2-female 1-male angled connector 725 (FIGS. 36A, 36B and 36C) has 2 female ends (727, 728) and 1 male end 726.

Figure 32A:
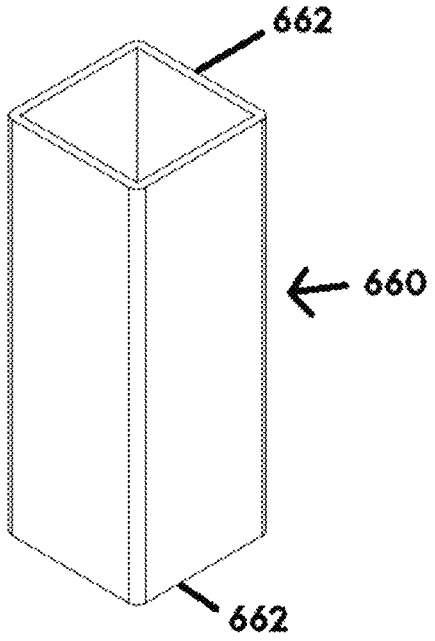
FIG. 32A is a perspective view of an embodiment of female-female connector.
Figure 32B:
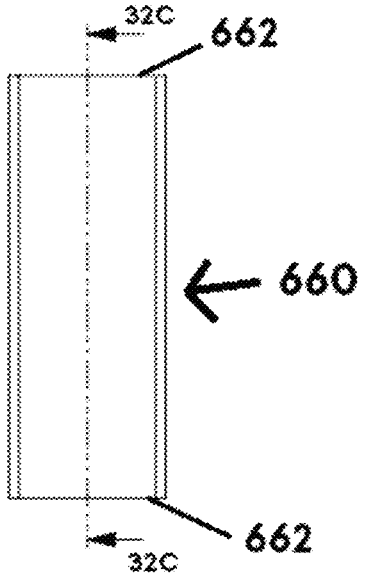
FIG. 32B is a side view of FIG. 32A.
Figure 32C:
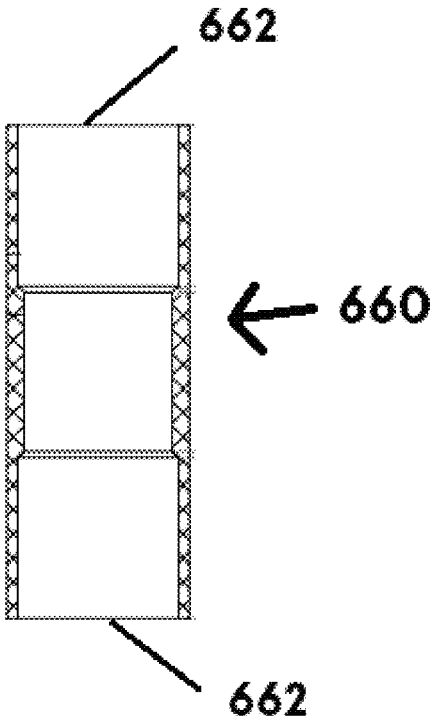
FIG. 32C is a cross-sectional view of FIG. 32B taken along the line 32C-32C.
Figure 32D:
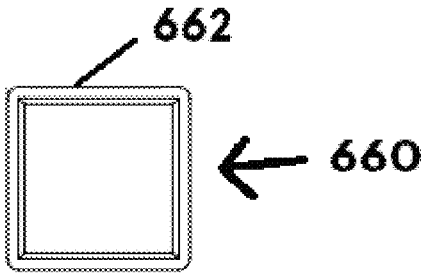
FIG. 32D is a top view of FIG. 32A.
Figure 33A:
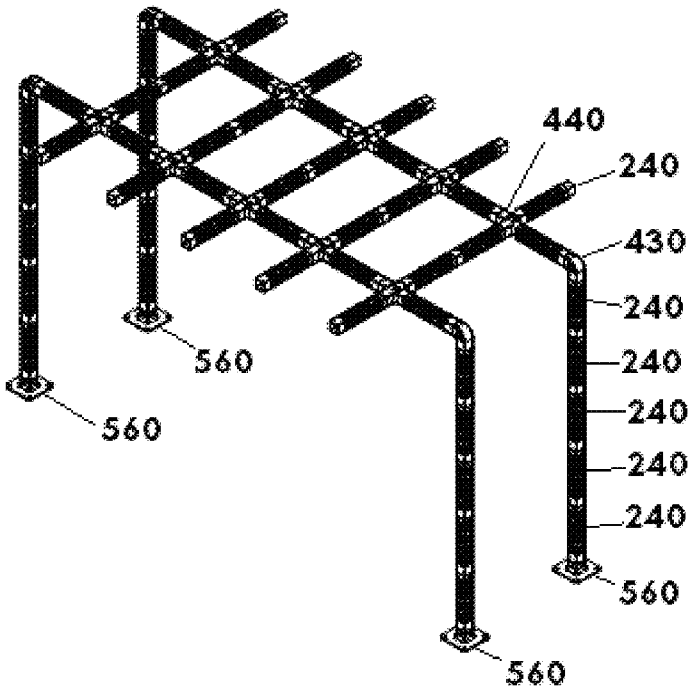
FIG. 33A is a perspective view of an assembled frame forming a trellis according to an embodiment of the present invention.
Figure 33B:
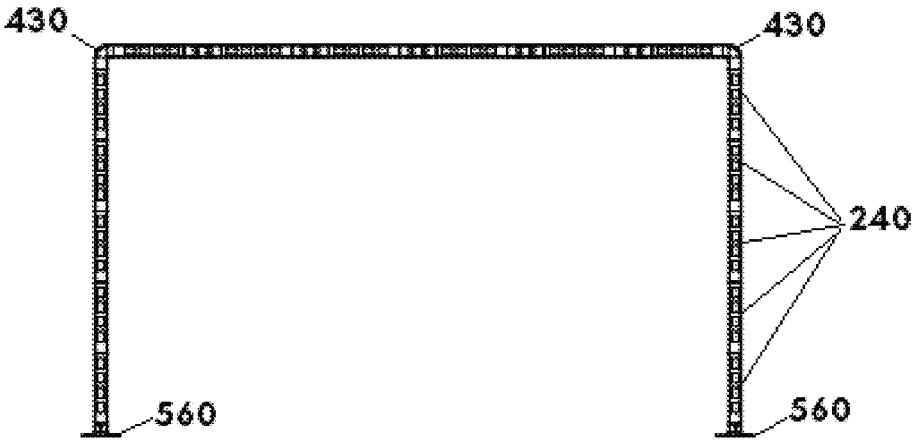
FIG. 33B is a side view of FIG. 33A.
Figure 33C:
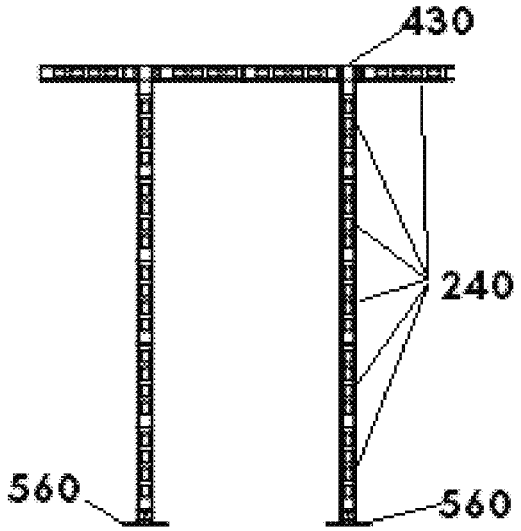
FIG. 33C is a front view of FIG. 33A.
Figure 33D:
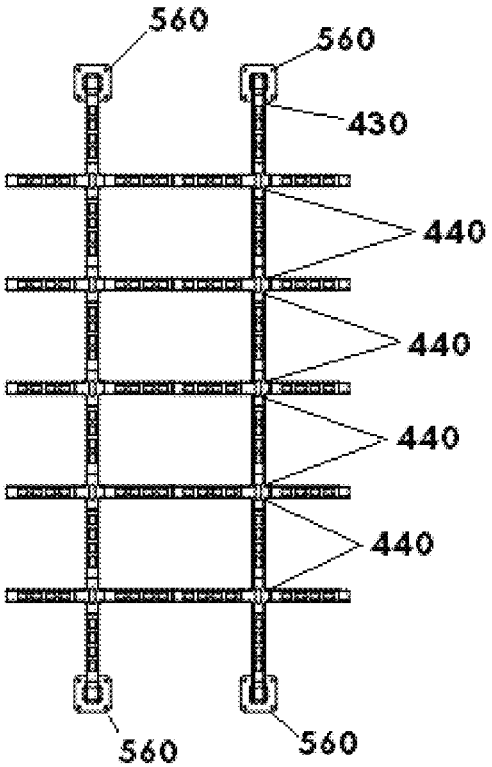
FIG. 33D is a top view of FIG. 33A.

The stretched 2-female connector 720 (FIGS. 37A, 37B and 37C0 has two female ends 722, 724) and is a longer version of FIG. 32A.

The male-female elbow connector FIGS. 39A and 39B) have a female end 744 and a male end 742.

It is understood that the connectors can have openings in their side walls, as is seen in FIGS. 3, 4, 16, 17, 18, 24 and 25. When they are present, these openings allow a user to feed wire, string lights, rope, etc. through the connectors and the openings also allow clips to be attached to the openings. It is also understood that the connectors may have no opening in their side walls.

The operator of the multipurpose modular framing system can choose to use one or more extenders 240 to connect an encloser 240 or connector (360, 370, 380, 390, 400, 410, 420, 430, 440, 450, 660) to the adapter and base. Alternatively, the operator can connect an encloser 240 or connector (360, 370, 380, 390, 400, 410, 420, 430, 440, 450, 660) directly to an adapter 200. The components of each modular unit fit together through the male and female connections. For example, as shown in FIG. 10A, an adapter 200 has an adapter bottom 210 that is a male end and an adapter top 220 that is a female end. The adapter bottom 210 is adapted to be received into the female shaped base top 160 of the base 140. Similarly, the female adapter top 220 is adapted to receive the male end of the extender bottom 250 of an extender 250. This male/female means of removeably attaching the components of each modular unit and the multipurpose modular framing system is that it creates modularity and allows the operator to creatively build structures into the shape and size of their liking.

In a further embodiment of the present invention a base 560 is provided, as shown in FIGS. 31A to 31D, having a base top 600 and a base bottom 580. The base bottom 580 rests on the ground or other surface and supports and stabilizes the modular unit 120. The base 560 may optionally comprise peg holes 640 at one or more corners of the base to insert pegs, stakes or similar objects into the peg holes 640 to secure the base 560 and thus the modular unit 120 into the ground or other surface. The peg holes also act to further stabilize the base in place when used to ensure further stability against light impacts, high impacts, or strong winds.

The base top 600 and base bottom 580 are open and the base is substantially hollow. The base top 600 has a male opening that is shaped to removably receive a female shaped extender top 260 of an extender 240; no adapter is utilized when base 600 is employed. The base top 600 and the extender top 260 are configured to allow the extender top 260 to slide securely into the base top 600 in a tight frictional engagement.

In this embodiment of the present invention, the base 560 features 4 side walls that form a substantially square shape. The side walls optionally have openings 620. The shape of base 560 and ability to connect directly to an extender allows the resulting modular units to be smaller in size.

When base 560 is used to form an embodiment of the modular framing system of the present invention, the female-female connector 660 may be used to join a female shaped extender bottom 250 to a male ended encloser bottom 290 or other connector having a male end. The female-female connector 660 can also be joined directly to the base top 600 of base 580.

In a further embodiment of the present invention, a user of the multipurpose modular framing system of the present invention is able to permanently join parts together at their own discretion by drilling screws using known means where the components of the modular framing system are connected together using the male/female connections. As is known, other means of permanently or semi-permanently connecting the components of the modular framing system may be used. For example, applying glue or other adhesives.

Figure 27:
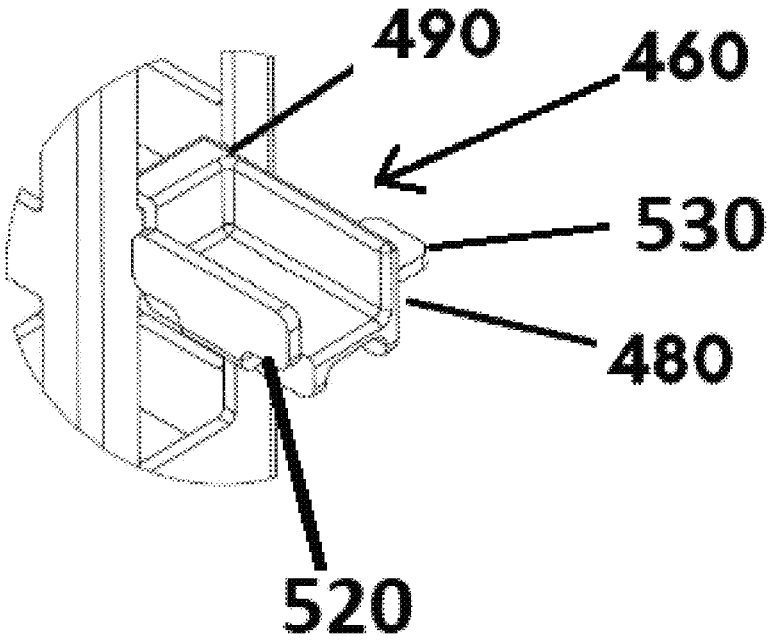
FIG. 27 is a perspective view of an embodiment of an assembled attachment connector clip as mounted to the side of an embodiment of the multi-purpose modular framing system of the present invention.
Figure 28A:
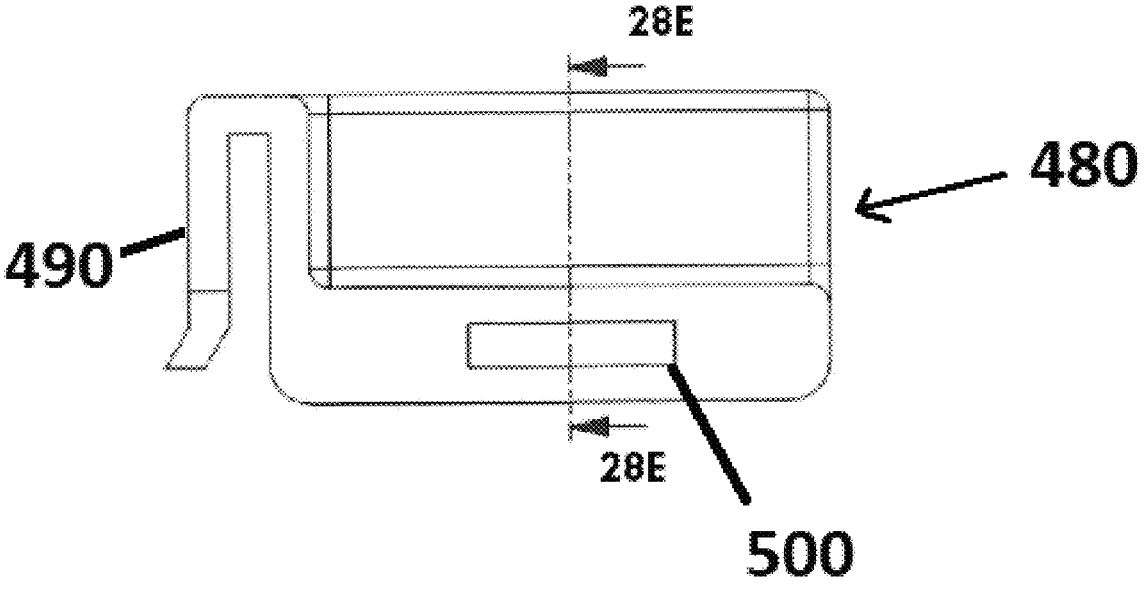
FIG. 28A is a side view of an attachment connector bracket of FIG. 27.
Figure 28B:
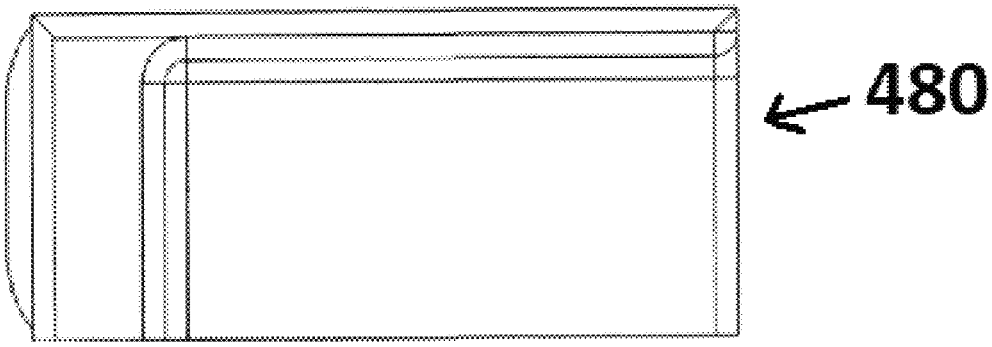
FIG. 28B is a top view of the attachment connector bracket of FIG. 27.
Figure 28C:
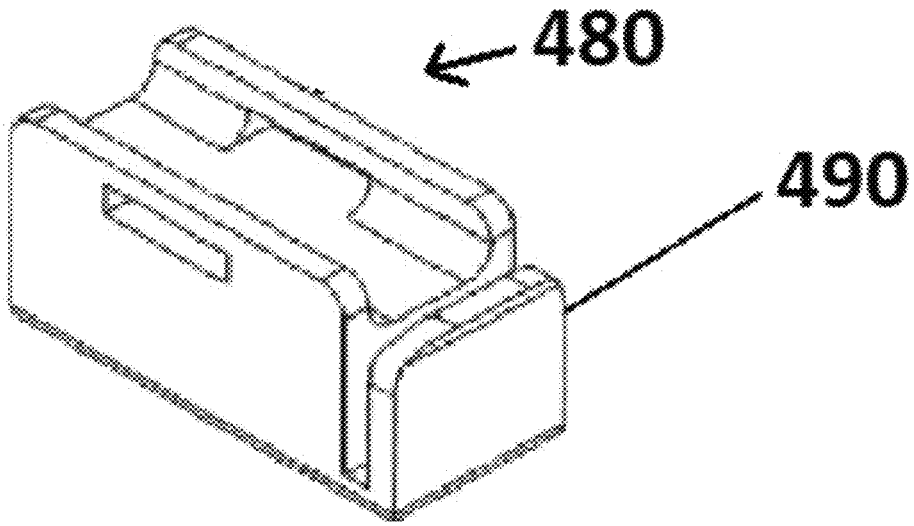
FIG. 28C is a bottom view of the attachment connector bracket of FIG. 27.
Figure 28D:
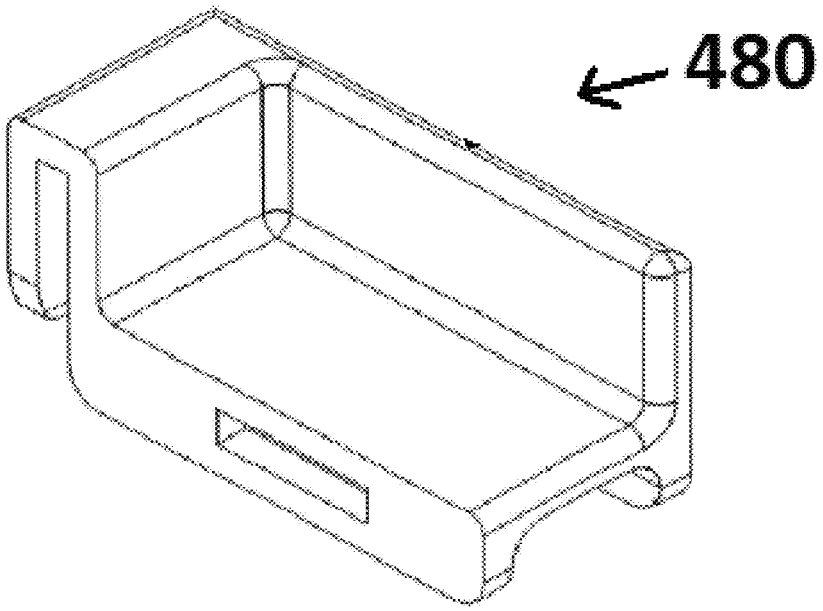
FIG. 28D is a perspective view of the attachment connector bracket of FIG. 27.
Figure 28E:
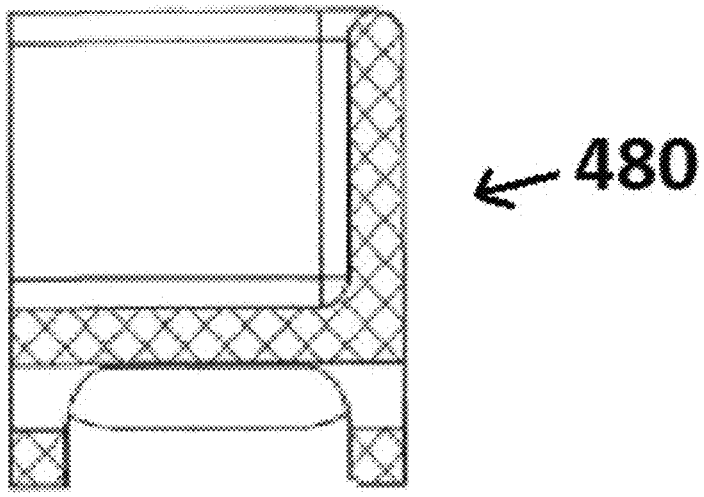
FIG. 28E is a cross-sectional view of the attachment connector bracket taken along the line 28E-28E from FIG. 28A
Figure 28F:
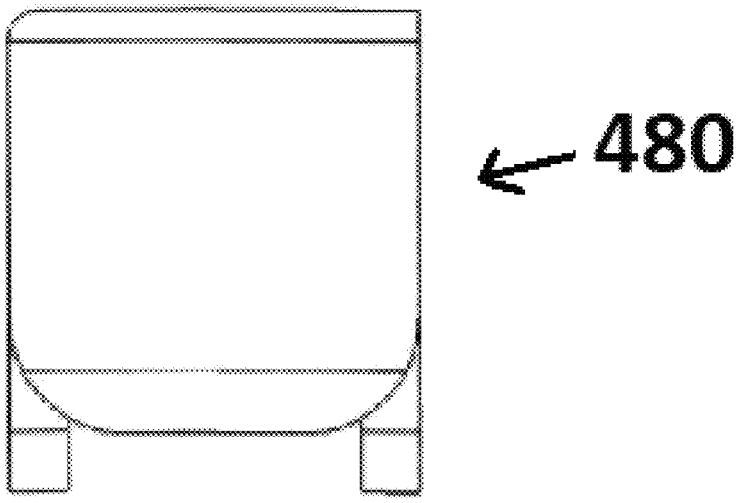
FIG. 28F is an end view of the attachment connector bracket of FIG. 27.
Figure 29A:
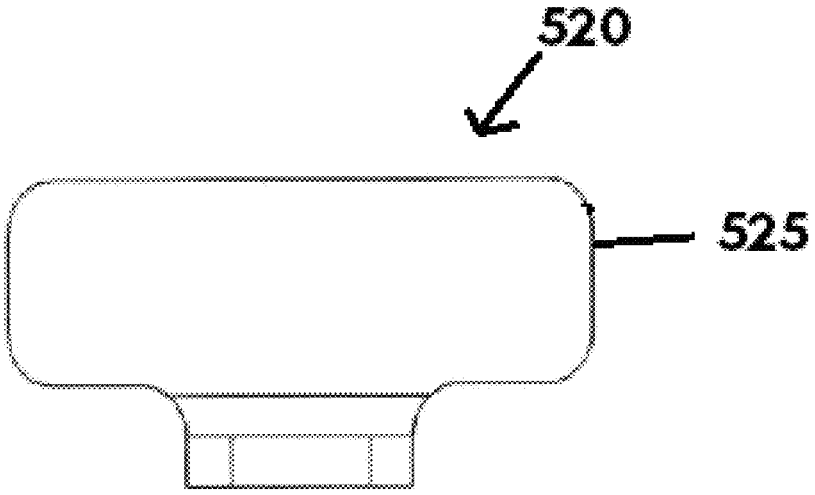
FIG. 29A is an end view of an attachment connector tongue according to an embodiment of the present invention.
Figure 29B:
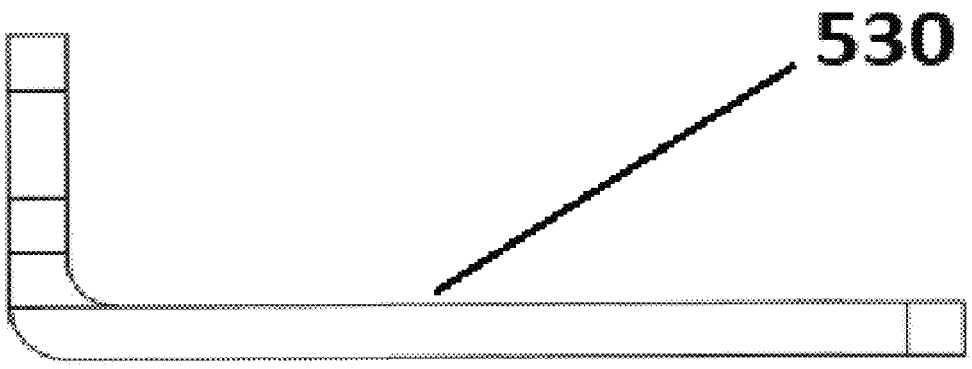
FIG. 29B is a side view of the attachment connector tongue.
Figure 29C:
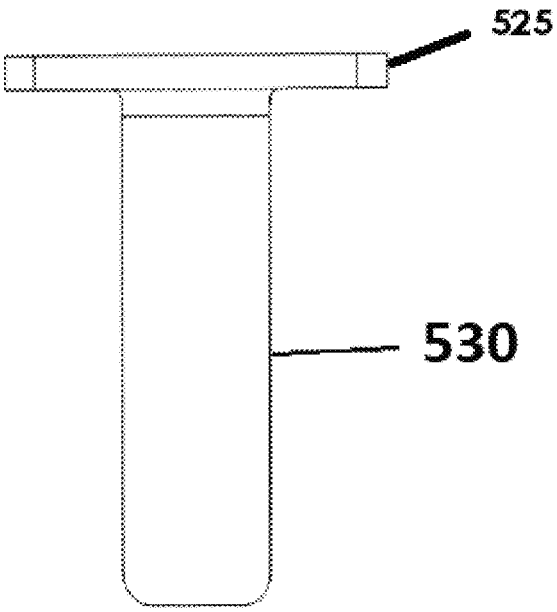
FIG. 29C is a top view of the attachment connector tongue.
Figure 29D:
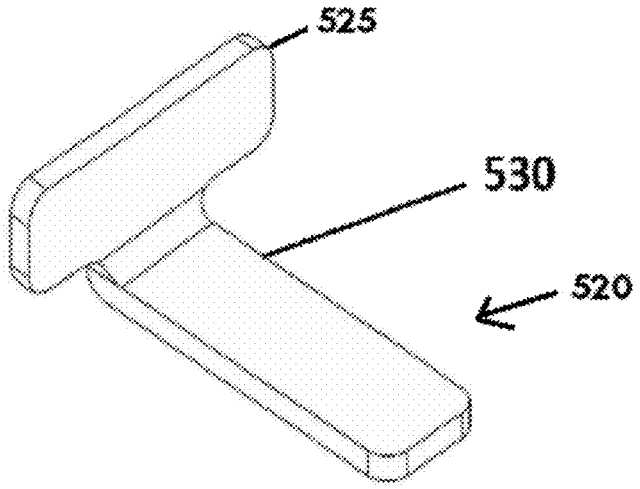
FIG. 29D is a perspective view of the attachment connector tongue.

In an embodiment of the present invention an attachment connector 460 is provided as shown in FIG. 27. The attachment connector comprises an attachment connector bracket 480 (see FIG. 28A to 28F) and an attachment connector tongue 520 (see FIG. 29A to 29D).

The attachment connector tongue 520 comprises an extended arm 530 with an end plate 525 at one end of the extended arm 530 that is substantially perpendicular to the extended arm 530.

The attachment connector bracket 480 has an overhang 490 allowing the attachment connector 460 to be attached to an opening on the base, the adapter, the extender, the encloser, or the connectors. For example, the attachment connector rests over the edges of the openings of part 170, 230, 270 and 310 of the base, adapter, extender, and encloser, respectively.

The bracket 480 also comprises a bracket base wall, a bracket side wall a bracket end wall, and a bracket opening 500 in the bracket base wall and the tongue 460 has an extended arm 530 such that when the extended arm 530 of the tongue is inserted into the opening 500 of the bracket 480 the attachment connector 460 is formed. The space defined by the bracket base wall, bracket side wall, the end plate 525 and the extended arm 530 creates a platform that may be varied in size by sliding the attachment connector tongue towards and away from the bracket through the opening 500.

The attachment connector being comprised of two parts allows the operator to decide whether to create a bigger platform for the placement of an object such as hurdles. If the object placed on the attachment connector is wide, the operator can simply pull the attachment connector tongue 460 away from the attachment connector bracket 480 to expand the surface to rest the wider object, such as a hurdle.

The way in which to attachment connector 460 is formed from the bracket and the tongue can provide either a more relaxed or a more secure grip on an object placed on top of the attachment connector. For example, depending on the thickness of the object that is to be placed on the attachment connector, such as a hurdle, the operator has the option to close the connector tongue 530 to allow the hurdle to be tight-fitted as it rests in the attachment connector as shown in FIG. 1.

Depending on the desired height of the operator of the said invention, the attachment connector can be elevated to a position higher up or lower down the multipurpose modular framing apparatus by clipping it into one of the openings (170, 230, 270, 310).

The multipurpose modular framing system can be made out of plastic for lightweight portability and easy assembly for activities such as hurdles training in track and field and agility training for both athletes and canines.

Each of the component parts of the modular units 120 of an embodiment of the present invention can be made out of plastic, and can also be made out of stronger materials for example but not limited to titanium, metal, steel, wood, or aluminum for construction purposes.

The ease of assembly of the said invention provides simplicity and convenience while the modularity provides functional value to an athlete, coach or trainer who can use the assembled multipurpose modular framing apparatus for agility training.

In an embodiment of the present invention, the dimensions of some of the component parts of the modular framing system may include: a base that is 11.25 inches in width and length at its bottom and 13.25 inches tall; an adapter that is 11.5 inches tall; two extenders that are each 11.5 inches tall; and an encloser top that is also 11.5 inches tall.

Figure 8A:
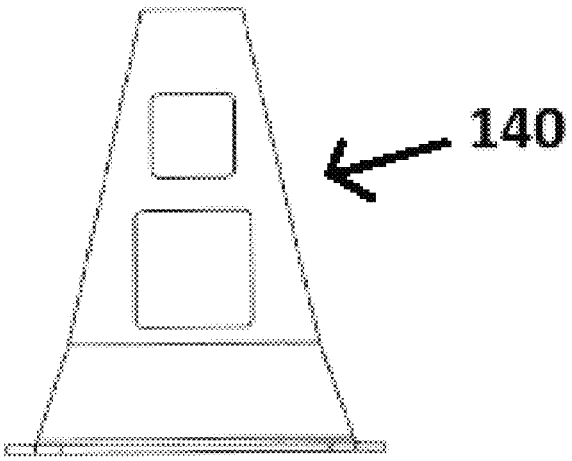
FIG. 8A is a side view of the base of FIG. 6.
Figure 8B:
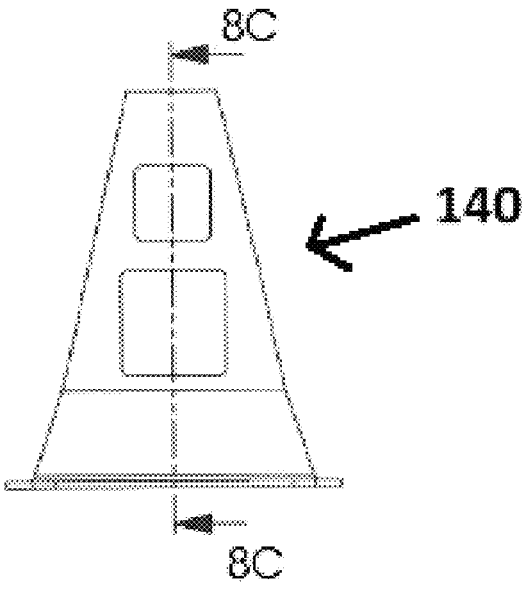
FIG. 8B is a side view of the base of FIG. 6.
Figure 8C:
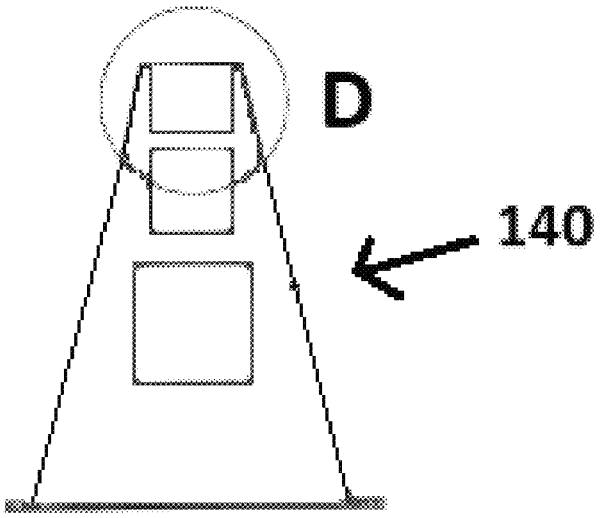
FIG. 8C is a cross-sectional view of the base taken along the line 8C-8C from FIG. 8B.
Figure 8D:
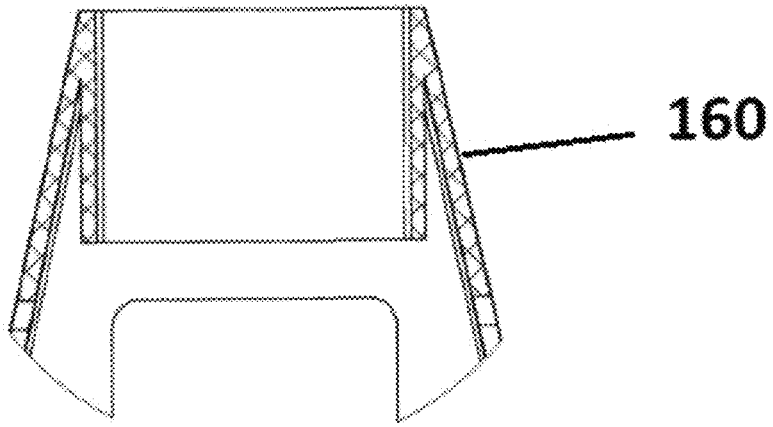
FIG. 8D is an enlarged view of D from FIG. 8C showing the female top end of the base cone.
Figure 8E:
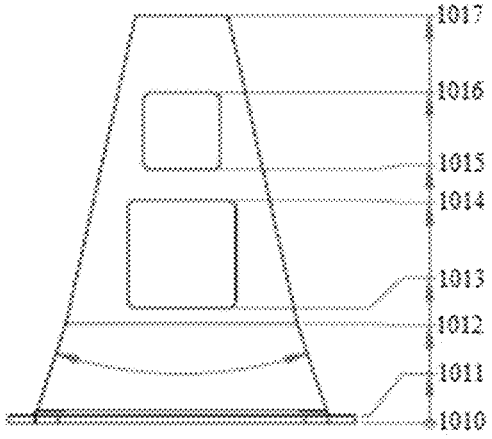
FIG. 8E is a side view of an embodiment of a base.

In an embodiment of the present invention, the dimensions of the base as shown in FIG. 8E are described relative to the height from bottom 1010 of the base to a linear plane of each part of the base as follows: bottom 1010 is 0 in [0 mm]; top side of the bottom 1011 is approximately 0.2500 in [6.35 mm]; lower portion 1012 is approximately 3.2500 in [82.55 mm]; bottom of first opening 1013 is approximately 3.7500 in [95.25 mm]; top of first opening 1014 is approximately 7.2500 in [184.15 mm]; bottom of second opening 1015 is approximately 8.2500 in [209.55 mm]; top of second opening 1016 is approximately 10.7500 in [273.05 mm]; and top of the base 1017 is approximately 13.2500 in [336.55 mm]. Further, the angle of the side of the base is approximately 37 degrees.

Figure 8F:
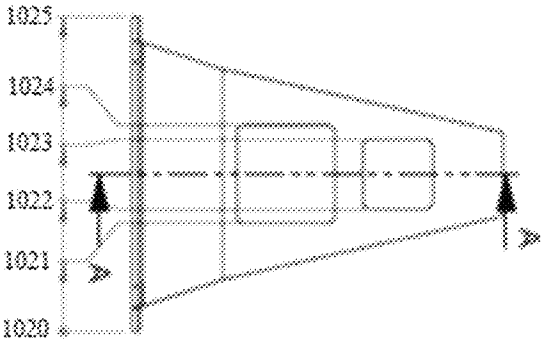
FIG. 8F is a side view of the base of FIG. 8E.

In an embodiment of the present invention, the dimensions of the base as shown in FIG. 8F are described relative to the width from right edge 1020 of the base to a linear plane of each part of the base as follows: right edge 1020 is 0 in [0 mm]; right side of first opening 1021 is approximately 3.8750 in [98.43 mm]; right side of second opening 1022 is approximately 4.3750 in [111.13 mm]; left side of second opening 1023 is approximately 6.8750 in [174.63 mm]; left side of first opening 1024 is approximately 7.3750 in [187.33 mm]; and left edge of the base 1025 is approximately 11.2500 in [285.75 mm].

Figure 8G:
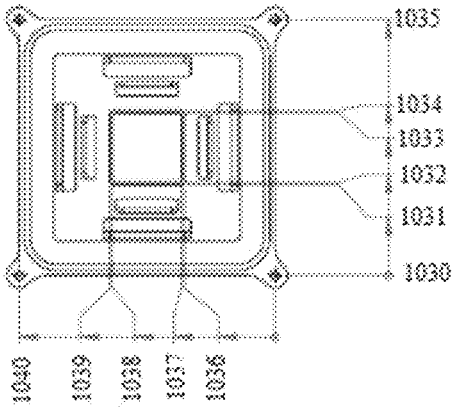
FIG. 8G is a cross-sectional view of the base taken along the line A-A from FIG. 8F.

In an embodiment of the present invention, the dimensions of the base as shown in FIG. 8G are described relative to the width or length from peg hole 1030 to a linear plane of each part of the base as follows: peg hole 1030 is 0 in [mm]; outer edge of bottom side of opening 1031 is approximately 3.6250 in [92.08 mm]; inner edge of bottom side of opening 1032 is approximately 3.7500 in [95.25 mm]; inner edge of top side of opening 1033 is approximately 6.5000 in [165.10 mm]; outer edge of top side of opening 1034 is approximately 6.6250 in [168.28 mm]; peg hole 1035 is approximately 10.2500 in [260.35 mm]; outer edge of right side of opening 1036 is approximately 3.6250 in [92.08 mm]; inner edge of right side of opening 1037 is approximately 3.7500 in [95.25 mm]; inner edge of left side of opening 1038 is approximately 6.5000 in [165.10 mm]; outer edge of left side of opening 1039 is approximately 6.6250 in [168.28 mm]; and peg hole 1040 is approximately 10.2500 in [260.35 mm]. Further, the radian of peg hole 1035 is approximately 0.5000 in [12.70 mm].

Figure 10E:
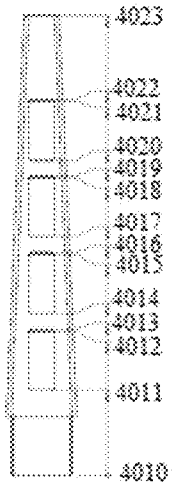
FIG. 10E is a side view of an embodiment of an adapter.

In an embodiment of the present invention, the dimensions of the encloser top as shown in FIG. 10E are described relative to the height from bottom side of male shaped adaptor bottom 4010 to a linear plane of each part of the encloser top as follows: bottom side of male shaped adaptor bottom 4010 is 0 in [0 mm]; bottom side of first opening 4011 is approximately 2.4547 in [62.35 mm]; lower edge of top side of first opening 4012 is approximately 4.1309 in [104.92 mm]; upper edge of top side of first opening 4013 is approximately 4.2031 in [106.76 mm]; bottom side of second opening 4014 is approximately 4.6506 in [118.12 mm]; lower edge of top side of second opening 4015 is approximately 6.3350 in [160.91 mm]; upper edge of top side of second opening 4016 is approximately 6.3989 in [162.53 mm]; bottom side of third opening 4017 is approximately 6.8464 in [173.90 mm]; lower edge of top side of third opening 4018 is approximately 8.5392 in [216.90 mm]; upper edge of top side of third opening 4019 is approximately 8.5948 in [218.31 mm]; bottom side of fourth opening 4020 is approximately 9.0423 in [229.67 mm]; lower edge of top side of fourth opening 4021 is approximately 10.7434 in [272.88 mm]; upper edge of top side of fourth opening 4022 is approximately 10.7906 in [274.08 mm]; and top side of female shaped adaptor top 4023 is approximately 13.2000 in [335.28 mm].

Figure 10F:
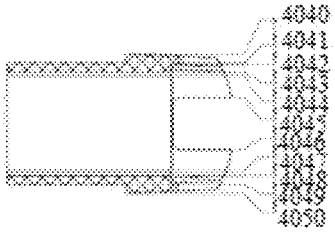
FIG. 10F is an enlarged view of a male shaped adapter bottom.

In an embodiment of the present invention, the dimensions of the male shaped adaptor bottom as shown in FIG. 10F are described relative to the width from leftmost edge 4040 of the male shaped adaptor bottom to a linear plane of each part of the male shaped adaptor bottom as follows: left most edge 4040 is 0 in [0 mm]; second left most edge 4041 is approximately 0.1251 in [3.18 mm]; third left most edge 4042 is approximately 0.1534 in [3.90 mm]; fourth left most edge 4043 is approximately 0.2501 in [6.35 mm]; fifth left most edge 4044 is approximately 0.3126 in [7.94 mm]; left inner edge 4045 is approximately 0.6250 in [15.88 mm]; right inner edge 4046 is approximately 1.3750 in [34.93 mm]; fourth right most edge 4047 is approximately 1.6874 in [42.86 mm]; third right most edge 4048 is approximately 1.7499 in [44.45 mm]; second left most edge 4049 is approximately 1.8749 in [47.62 mm]; and right most edge 4045 is approximately 2.0000 in [50.80 mm].

Figure 12A:
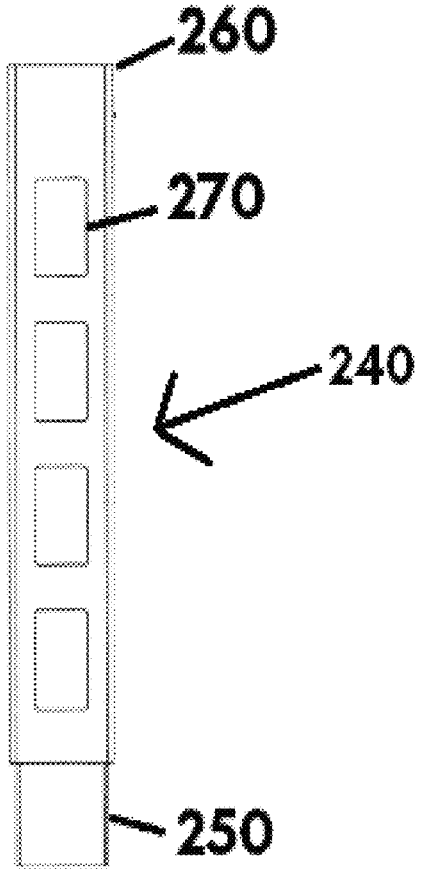
FIG. 12A is a side view of an extender of an embodiment of the present invention.
Figure 12B:
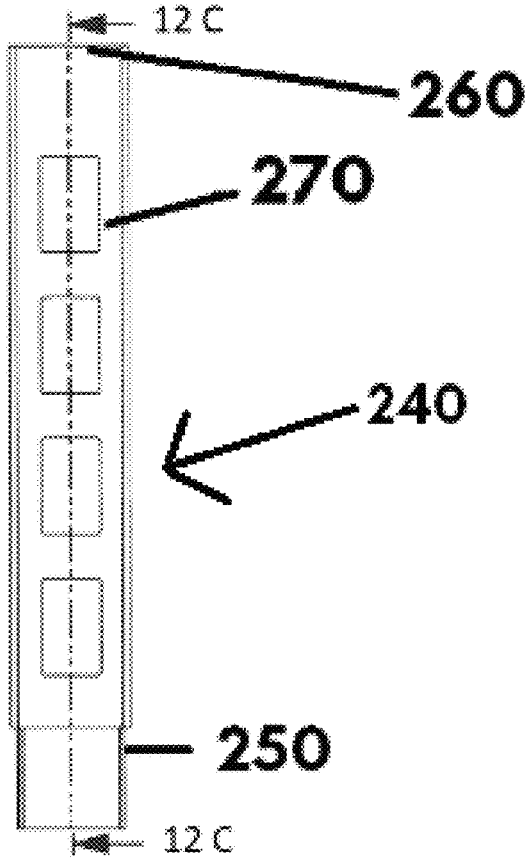
FIG. 12B is a side a view of the extender of FIG. 12A.
Figure 12C:
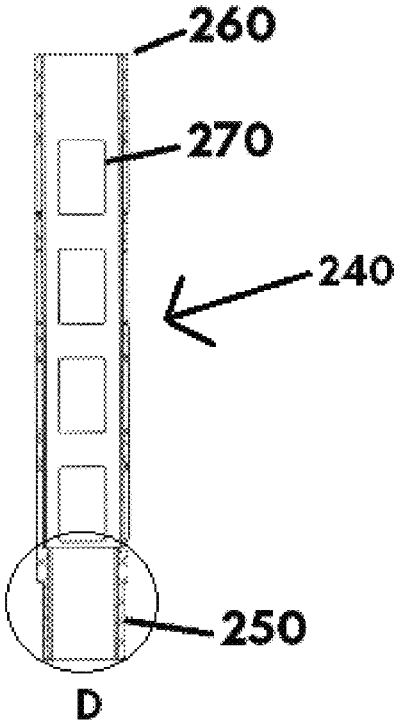
FIG. 12C is a cross-sectional view of the extender taken along the line 12C-12C from FIG. 12B.
Figure 12D:
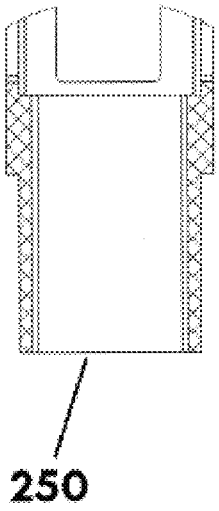
FIG. 12D is an enlarged view of the circle D shown in FIG. 12C.
Figure 12E:
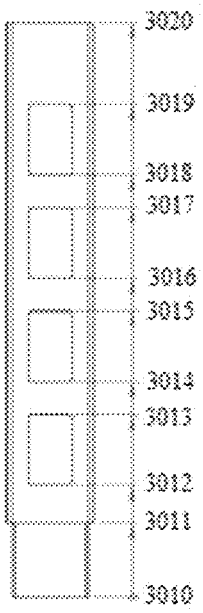
FIG. 12E is a side view of an extender of an embodiment of the present invention.

In an embodiment of the present invention, the dimensions of the extender as shown in FIG. 12E are described relative to the height from bottom side of male shaped extender bottom 3010 to a linear plane of each part of the extender as follows: bottom side of male shaped extender bottom 3010 is 0 in [0 mm]; bottom side of the extender 3011 is approximately 1.7000 in [43.18 mm]; bottom side of first opening 3012 is approximately 2.5750 in [65.41 mm]; top side of first opening 3013 is approximately 4.2000 in [106.68 mm]; bottom side of second opening 3014 is approximately 4.9500 in [125.73 mm]; top side of second opening 3015 is approximately 6.5750 in [167.01 mm]; bottom side of third opening 3016 is approximately 7.3250 in [186.06 mm]; top side of third opening 3017 is approximately 8.9500 in [227.33 mm]; bottom side of fourth opening 3018 is approximately 9.7000 in [246.38 mm]; top side of fourth opening 3019 is approximately 11.3250 in [287.66 mm]; and top side of the extender 3020 is approximately 3020.

Figure 12F:
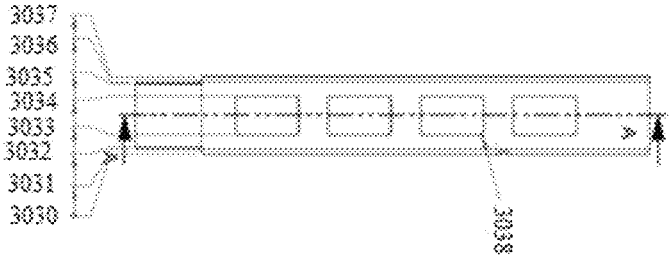
FIG. 12F is a side view of an extender of an embodiment of the present invention.

In an embodiment of the present invention, the dimensions of the extender as shown in FIG. 12F are described relative to the width from right side of the extender 3030 to a linear plane of each part of the extender as follows: right side of the extender 3030 is 0 in [0 mm]; outer right side of male shaped extender bottom 3031 is approximately 0.1250 in [3.18 mm]; inner right side of male shaped extender bottom 3032 is approximately 0.1875 in [4.76 mm]; right side of first opening 3033 is approximately 0.5000 in [12.70 mm]; left side of first opening 3034 is approximately 1.5000 in [38.10 mm]; inner left side of male shaped extender bottom 3035 is approximately 1.8125 in [46.04 mm]; outer left side of male shaped extender bottom 3036 is approximately 1.8750 in [47.63 mm]; and left side of the extender 3037 is approximately 2.0000 in [50.80 mm]. Further, the radian of the corner of third opening 3038 is approximately 0.0625 in [1.59 mm].

Figure 12G:
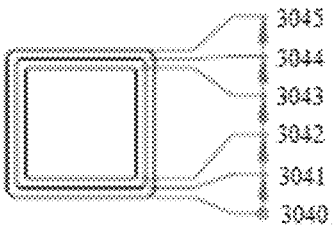
FIG. 12G is a bottom view of an extender of an embodiment of the present invention.

In an embodiment of the present invention, the dimensions of the bottom of the extender as shown in FIG. 12G are described relative to the length from the bottom side of the outer edge of the extender 3040 to a linear plane of each part of the bottom of the extender as follows: bottom side of outer edge 3040 is 0 in [0 mm]; bottom side of inner edge 3041 is approximately 0.1250 in [3.18 mm]; bottom side of innermost edge 3042 is approximately 0.2500 in [6.35 mm]; top side of innermost edge 3043 is approximately 1.7500 in [44.45 mm]; top side of inner edge 3044 is approximately 1.8750 in [47.63 mm]; top side of outer edge 3045 is approximately 2.0000 in [50.80 mm].

It is understood that while the dimensions of certain embodiments of the invention are shown above, the size of the present invention may be scaled up for use with larger sized projects such as tent structures and may also be scaled down for small projects such as toys.

Figure 30:
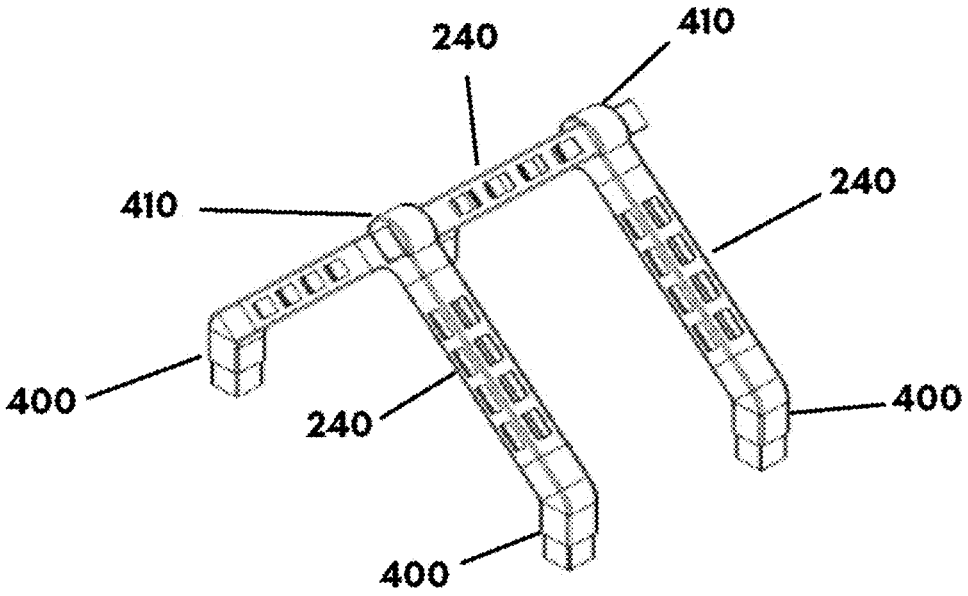
FIG. 30 is a perspective view of an assembled frame according to an embodiment of the present invention.
Figure 31A:
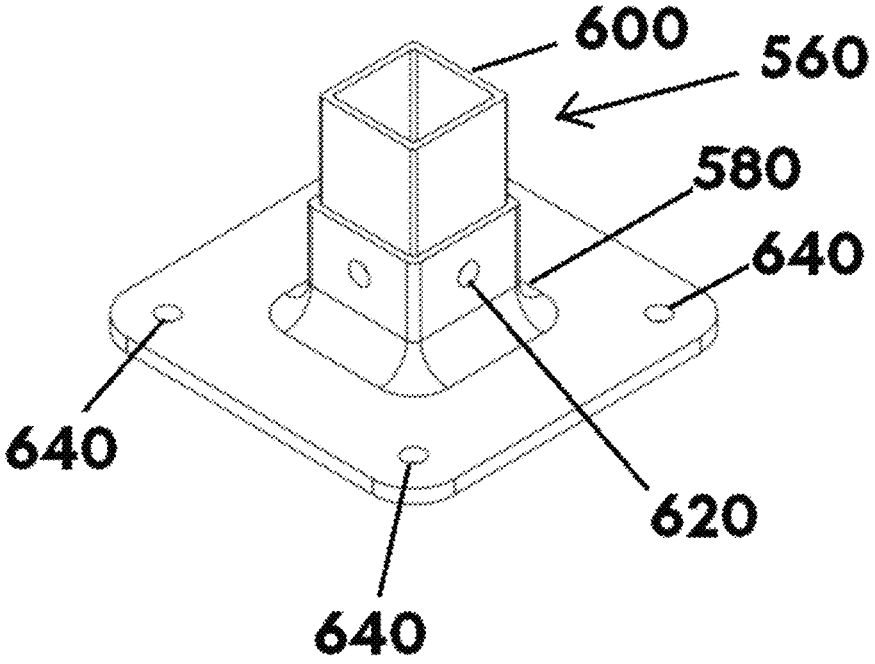
FIG. 31A is a perspective view of an embodiment of a square base of the present invention.
Figure 31B:
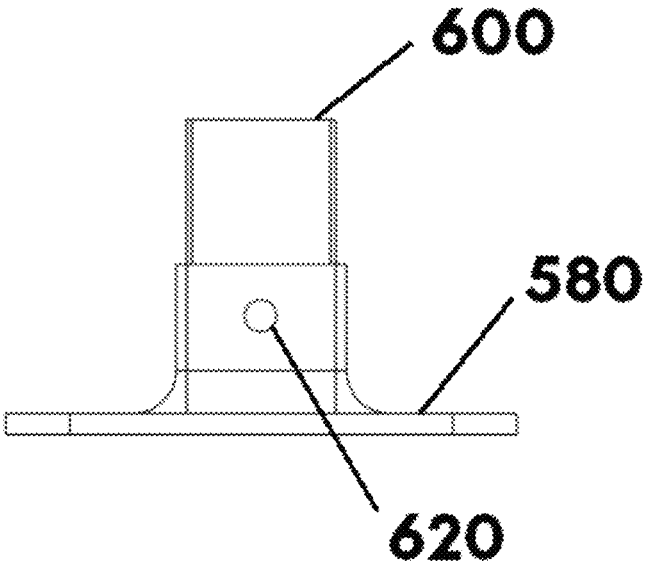
FIG. 31B is a side view of the square base of FIG. 31A.
Figure 31C:
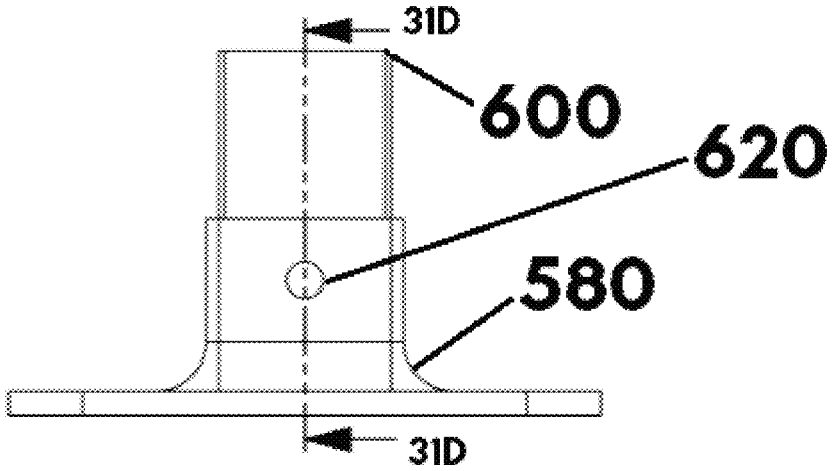
FIG. 31C is a side view of the square base of FIG. 31A.
Figure 31D:
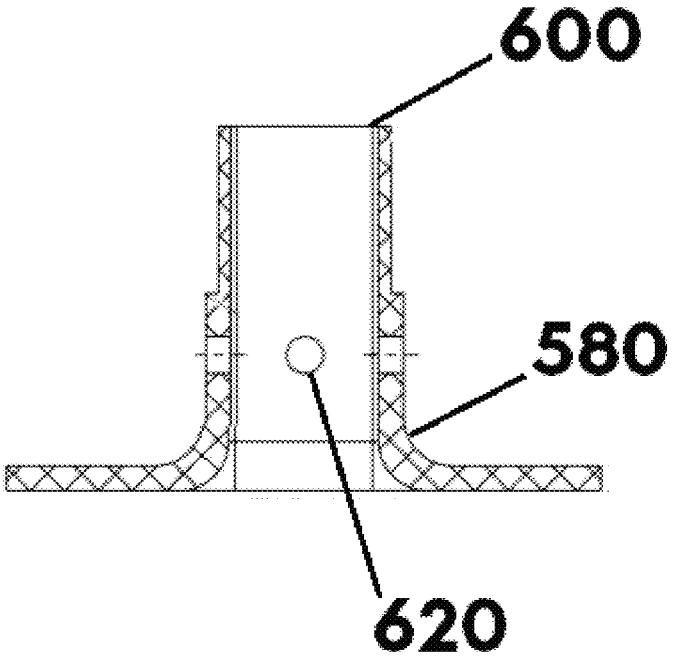
FIG. 31D is a cross-sectional view of FIG. 31C taken along the line 31D-31D.

In operation, the component pieces of the modular framing system of the present invention can be used to create different structures. For example, as seen in FIG. 30 a roof structure may be assembled (not shown attached to an adapter and a base). Four angled elbow extenders 400 are each connected to a respective extender 240. Each of these extenders 240 are connected to one of two 3-male 1-female connector 410 and one extender is connected to both 3-male 1-female connectors 410. It will be understood that further units will be added to complete a roof.

Another example of the modular framing system of the present invention is found in FIG. 1, wherein two modular units are assembled, each having a base, an adapter, two extenders and an enclosure top. An attachment connector is mounted onto an opening in one of the extenders and a second attachment connector is mounted onto an opening in one of the extenders in the other modular unit at the same distance from the base. A hurdle bar 110 is then rested on the attachment connectors to form a hurdle that can be used for track and field races.

An example of the modular framing system of the present invention in use as a trellis is found in FIGS. 33A to 33D. The male tops 600 of four-square bases 560 are connected to the female extender tops 260. Five extenders 240 are connected to one another and the extender male bottom of the extender furthest from the base are connected to a male-male connector 430, additional extenders 240 and 3-female 1-male cross connectors 440 are used to form a "ladder" appearance top frame of the trellis, allowing plants and vines to weave around and through the frame.

Figure 34A:
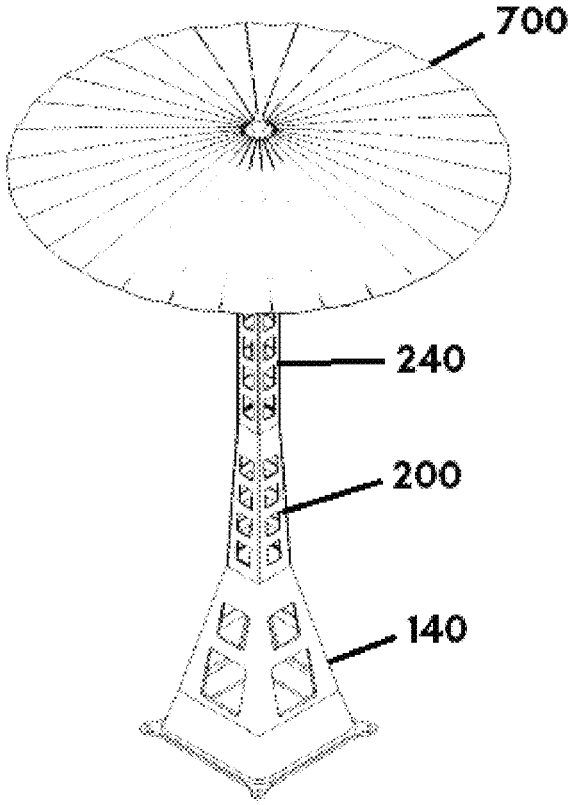
FIG. 34A is a perspective view of an assembled frame forming an umbrella holder according to an embodiment of the present invention.
Figure 34B:
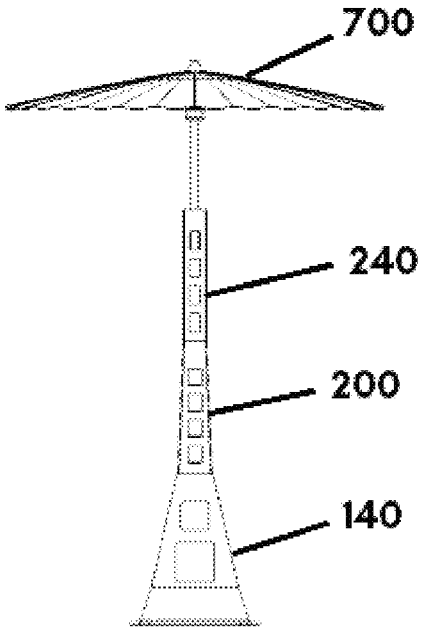
FIG. 34B is a side view of FIG. 34A.
Figure 34C:
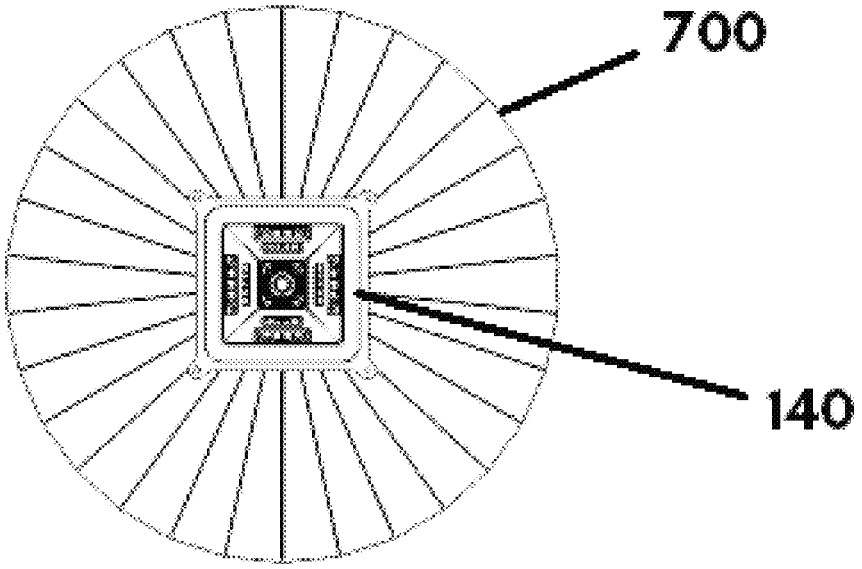
FIG. 34C is a top view of FIG. 34A.

An example of the modular framing system of the present invention in use as an umbrella stand is found in FIGS. 34A to 34C. A base 140 is connected to an adapter 200 and the adapter in turn is connected to an extender 240. The open female shaped extender top 260 coupled with the hollow nature of the extender 240, generally, allows an umbrella 700 to be inserted into the extender top.

It is understood that the modular framing system of the present invention may be made of a variety of materials including, but not limited to: rubbers such as polybutadiene rubber, styrene butadiene rubber (SBR), polymethyl methacrylate (PMMA), polycarbonate (PC), polyacetal, high-density polyethylene (HDPE), ethylene propylene rubber; titanium; steel; iron; graphene; metal; rare-earths; buckypaper; Dyneema™; reinforced polymer; wood; cork; and biodegradable versions of rubber, plastics, wood.

The hollow nature of the modular framing system of the present invention permits the modular units and the framing system to be lightweight, making it easy to carry/transport and assemble/disassemble without being too heavy for its user. The openings on the side walls of the base, adapter, extender and top encloser unit allow clips to be attached to any of these components so additional objects may be attached to the modular framing system. In addition, other objects, such as drywall may be simply glue or mechanically fastened to any or all components of the modular system. For example, the present invention may be used to create an A-frame type roof which a user could then use clips to attach a tarp to the frame to create a tent.

The modular framing systems also allows the formation of net support posts to be formed for activities such as tennis and badminton.

The modular units and multipurpose modular framing system of the present invention possesses numerous benefits and advantages over known modular framing systems, particularly those that may be used for agility training pole sets, hurdle systems, flat and agility cones and net support posts. The present invention utilizes a modular mechanism to allow connectability between parts of the system to provide vertical height gain to support a greater variety of training drills and activities thereby allowing multi-purpose utility of the system. Moreover, the modular agility training system does not any special tools to assemble or disassemble and therefore diminishes assemble labor requirements and special training.

The present invention is used in a variety of applications including but not limited to creating agility training structures for athletic training, creating hurdles for track and field, creating hurdles for canine training or horse jumping, creating framing structures for tents, shelters, sheds, dog kennels and gazebos, creating frames for fences and gates, creating framing structures for supporting goal nets and posts for soccer, hockey, rugby. A further embodiment is a structure to securely hold a beach umbrella using 140 and 200 and camping pegs so that you do not need to dig deep just to twist the umbrella into the sand.

The modular framing system of the present invention may also be used to make structures, such as animal kennels, dog houses, umbrella stands, etc. Given the hollow nature of the base, adapter and extender, the modular framing system of the present invention may be used for structures requiring electrical or other wiring, for example, a greenhouse, as the wiring and/or lighting is fed through the hollow interior of the modular framing system. An embodiment of the modular framing system of the present invention is used as a garden trellis and the hollow parts and openings allow and plants to weave around its parts.

Due to its multi-purpose characteristics and simplicity in use and installation, the modular agility training system invention realizes multi-purpose practicability all within one single system which reduces equipment costs.

It is understood that the modular framing system of the present invention is ideal for transport, storage, and quick assembly/disassembly. Its uses are ideally smaller in scale, and the present invention is not directed towards large scale construction projects, prefab structures, etc.

While embodiments of the invention have been described in the detailed description, the scope of the claims should not be limited by the preferred embodiments set forth in the examples, but should be given the broadest interpretation consistent with the description as a whole.

What is claimed is:

1. A modular framing system comprising:

a base that is substantially hollow having a base top, a base bottom and base side walls having side openings, wherein the base top is a female opening, wherein the base is substantially square and the square-shaped base bottom is larger than the square-shaped base top to provide stability to the modular framing system;

an adapter that is substantially hollow having an adapter top, an adapter bottom and adapter side walls having side openings, wherein the adapter top is a female-shaped opening and the adapter bottom is a male-shaped open projection and the adapter bottom is shaped to be received by the base top allowing the adapter side walls and the base side walls to be are flush with one another when connected together;

one or more extenders that are substantially hollow having an extender top, an extender bottom and extender side walls having extender side wall openings, wherein the extender top is a female-shaped opening and the extender bottom is a male-shaped open projection shaped to be received by the adapter top, wherein the adapter side walls and the extender side walls are flush with one another when connected together; and at least one attachment structure adapted to be removably attached at an edge of any one of the extender side wall openings; and wherein the attachment structure further comprises a bracket opening and an attachment structure tongue that is adapted to be slidably received by the bracket opening allowing the attachment structure tongue to be extended and retracted substantially perpendicularly away from the bracket forming a platform that may be varied in size by sliding the attachment structure tongue towards and away from the bracket through the bracket opening.

2. The modular framing system of claim 1, further comprising one or more connectors.

3. The modular framing system of claim 1, further comprising an elbow-shaped connector having a first male end and a second female end, said first male end adapted to be received by the extender top or the adapter top.

4. The modular framing system of claim 1, further comprising a connector with a first and second female end and a third male end, said third male end adapted to be received by the extender top or the adapter top.

5. The modular framing system of claim 1, further comprising a connector with a first, second and third female end and a fourth male end, said fourth male end adapted to be received by the extender top or the adapter top.

6. The modular framing system of claim 1, further comprising a connector with a first, second, third and fourth female end and a fifth male end, said fifth male end adapted to be received by the extender top or the adapter top.

7. The modular framing system of claim 1, further comprising a connector with an elbow-shaped connector have a first and second male end, wherein said first and second male ends are adapted to be received by the extender top or the adapter top.

8. The modular framing system of claim 1, further comprising a connector with one female end and three male ends, wherein said three male ends are adapted to be received by the extender top or the adapter top.

9. The modular framing system of claim 1, further comprising a connector with five female ends and one male end, wherein said male end is adapted to be received by the extender top or the adapter top.

10. A modular framing system comprising:

a base that is substantially hollow having a base top, a base bottom and base side walls having side wall openings, wherein the base top is a male-shaped open projection, wherein the base is substantially square and the square-shaped base bottom is larger than the square-shaped base top to provide stability to the modular framing system;

one or more extenders that are substantially hollow having an extender top, an extender bottom and extender side walls having extender side wall openings, wherein the extender top is a male-shaped open projection and the extender bottom is a female opening and the extender top is shaped to be received and secured to the base top via frictional engagement;

one or more connectors comprising at least one female opening and/or at least one male-shaped open projection;

at least one attachment structure adapted to be removably attached at an edge of any one of the extender side wall openings wherein the male-shaped open projection of the base top is recessed from an exterior edge of the base top, and wherein the female opening of the extender bottom is flush with the extender side walls, and when one extender of the one or more extenders is secured to the base by way of the frictional engagement of the male-shaped open projection of the base and the female opening of another extender of the one or more extenders, the base side walls and extender side walls are flush with one another;

and wherein the male-shaped open projection of the one or more extenders is recessed from an exterior edge of the extender bottom, and when one extender of the one or more extenders is secured to another extender of the one or more extenders by way of frictional engagement of the female opening of the extender bottom and the male-shaped open projection of the extender top, the extender side walls of both extenders are flush with one another;

and wherein the one or more connectors are removably attached to the one or more extenders and the extender side walls are flush with side walls of the one or more connector where the extender and connector are attached and wherein the at least one attachment structure further comprises a bracket opening and an attachment structure tongue that is adapted to be slidably received by the bracket opening allowing the attachment structure tongue to be extended and retracted substantially perpendicularly away from the bracket forming a platform that may be varied in size by sliding the attachment structure tongue towards and away from the bracket through the bracket opening.

11. The modular framing system of claim 10, wherein the one or more connectors has two female ends, said female ends adapted to receive the male-shaped open projection of the base top or the male-shaped open projection of the extender top.

12. The modular framing system of claim 10, wherein the one or more connectors is an elbow-shaped connector having a first male end and a second female end, said second female end adapted to receive the male shaped base top or the male shaped extender bottom.

13. The modular framing system of claim 10, wherein the one or more connectors have a first and second female end and a third male end, first and second female ends are adapted to receive the male-shaped open projection of the base top or the male-shaped open projection of the extender top.

14. The modular framing system of claim 10, wherein the one or more connectors have a first, second and third female end and a fourth male end, said first, second and third female ends are adapted to receive the male-shaped open projection of the base top or the male-shaped open projection of the extender top.

* * * * *